US009447966B2

(12) United States Patent
Babington

(10) Patent No.: US 9,447,966 B2
(45) Date of Patent: Sep. 20, 2016

(54) FUEL BURNER

(71) Applicant: Babington Technology LLC, Rocky Mount, NC (US)

(72) Inventor: Robert S. Babington, McLean, VA (US)

(73) Assignee: BABINGTON TECHNOLOGY LLC, Rocky Mount, NC (US)

( * ) Notice: Subject to any disclaimer, the term of this patent is extended or adjusted under 35 U.S.C. 154(b) by 0 days.

(21) Appl. No.: 14/546,260

(22) Filed: Nov. 18, 2014

(65) Prior Publication Data

US 2016/0138802 A1 May 19, 2016

(51) Int. Cl.
*F23D 11/12* (2006.01)
*F23D 11/40* (2006.01)

(52) U.S. Cl.
CPC ..... *F23D 11/12* (2013.01); *F23D 11/404* (2013.01)

(58) Field of Classification Search
CPC ..... F23D 11/12; F23D 11/10; F23D 11/40; F23D 11/404; F23D 11/44; F23D 2214/00; F23C 6/045; F23C 2900/06041
See application file for complete search history.

(56) References Cited

U.S. PATENT DOCUMENTS 4,507,074 A * 3/1985 Babington et al. ..... 431/12

* cited by examiner

*Primary Examiner* — Alfred Basichas
(74) *Attorney, Agent, or Firm* — Polsinelli PC

(57) ABSTRACT

A burner is provided. The burner includes an air compressor, an atomizing head having an air orifice, first and second fuel tanks, the first fuel tank being located at least partially below the atomizing head, and the second fuel tank being located at least partially above the atomizing head, a first fluid pathway connecting the air compressor to the air orifice of the atomizing head, a second fluid pathway having a first end configured to receive air from the air compressor, and a second end extending into the first fuel tank, a third fluid pathway connecting from the first fuel tank to the second fuel tank, and a fourth fluid pathway connecting the secondary fuel tank to a distribution point above the atomizing head. The second and third fluid pathway define at least a portion of a bubble pump. The burner is configured to use air from the air compressor to both (a) deliver fuel to the atomizing head, and (b) atomize the delivered fuel at the atomizing head.

11 Claims, 25 Drawing Sheets

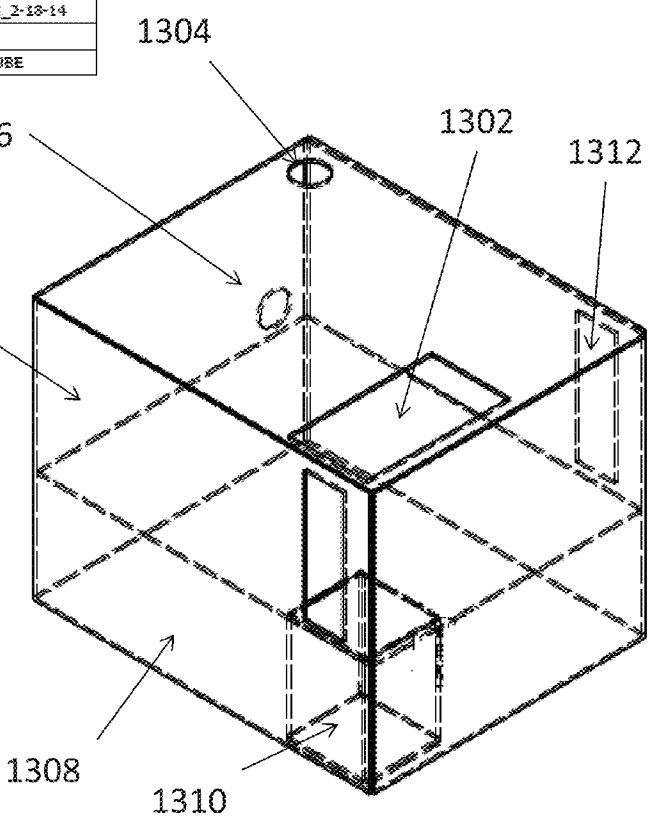
Fig. 13
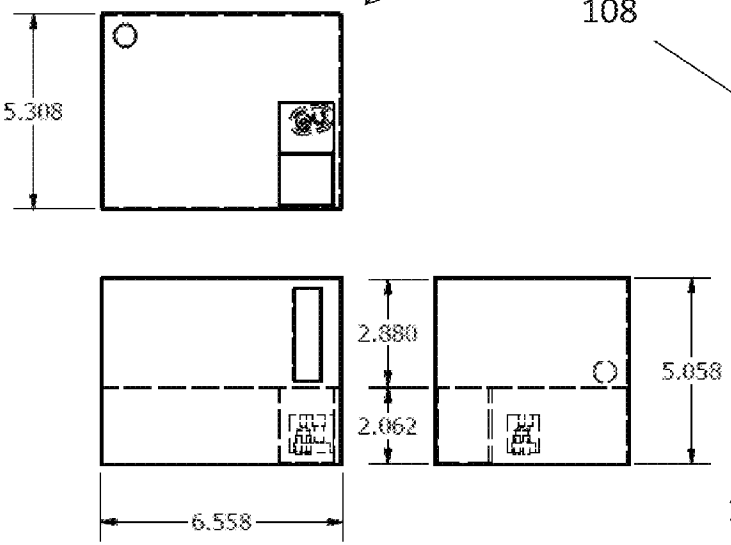
PARTS LIST
| ITEM | QTY | PART NUMBER | DESCRIPTION |
|---|---|---|---|
| 1 | 1 | 228-06-C0018 | RSB_FUEL_SUMP_REVISED_3_13_14 |
| 2 | 1 | 228-06-C0027 | RSB_FUEL_SUMP_REVISED_3_13_14_PART_2 |
| 3 | 1 | 228-06-C0014 | RSB_FUEL_SUMP_REVISED_3_13_14_TOP |
| 4 | 1 | 228-06-C0028 | RSB_FUEL_SUMP_REVISED_3_13_14_PART_4 |
| 5 | 2 | 228-06-C0013 | RSB_FUEL_SUMP_REVISED_3_13_14_PART_5 |
| 6 | 1 | 228-06-C0015 | RSB_FUEL_SUMP_REVISED_3_13_14_PART_6 |
| 7 | 1 | 3270_low_pressure_distributer_2-18-14 | 3270_LOW_PRESSURE_DISTRIBUTER_2-18-14 |
| 8 | 1 | 2158-06-C0001 | CROSS OVER TUBE PLUG |
| 9 | 1 | 228-06-C0011 | 270-00- 00004 - COMPRESSED AIR TUBE |

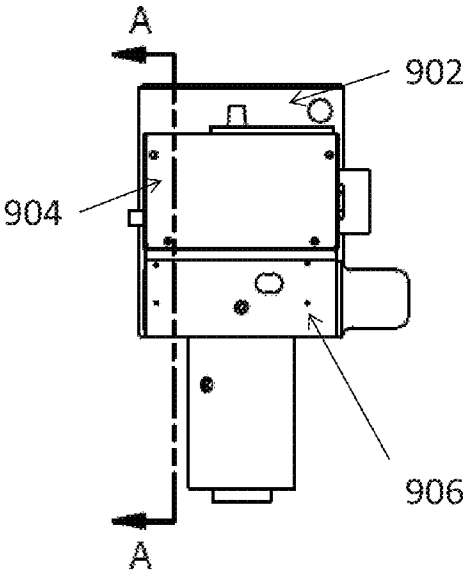
Fig. 14
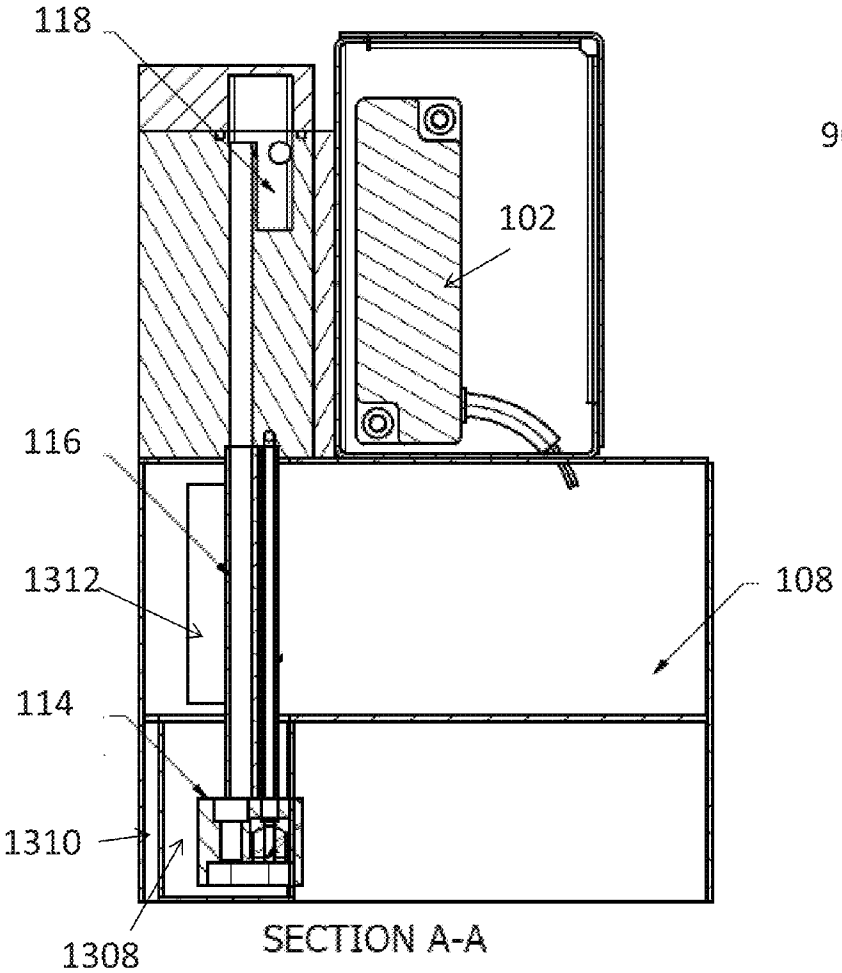

PARTS LIST

| ITEM | QTY | PART NUMBER | DESCRIPTION |
|---|---|---|---|
| 1 | 1 | 228-06-C0014 | LOW PRESSURE DISTRIBUTER |
| 2 | 1 | 228-06-C0001 | CROSS OVER TUBE PLUG |
| 3 | 1 | 228-86-C0012 | FUEL BUBBLE RETURN TUBE |
| 4 | 1 | 228-86-C0013 | AIR TUBE |

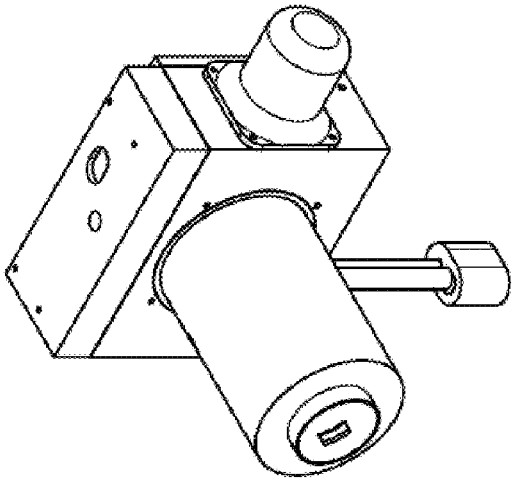
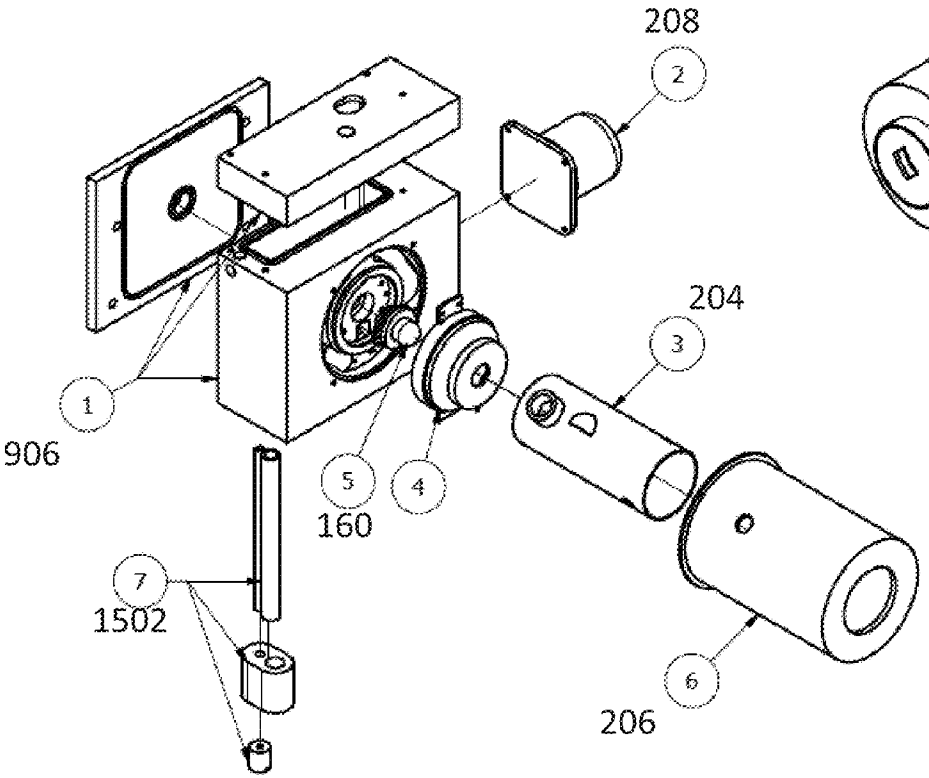
Fig. 16
PARTS LIST
| ITEM | QTY | PART NUMBER | DESCRIPTION |
|---|---|---|---|
| 1 | 1 | 228-05-00088 | BUBBLE PUMP BODY ASSEMBLY |
| 2 | 1 | 228-06-00092 | FAN |
| 3 | 1 | 228-06-00093 | FLAME TUBE |
| 4 | 1 | 228-06-00094 | BULLET COVER |
| 5 | 1 | 228-06-00095 | BULLET |
| 6 | 1 | 228-06-00096 | AIR TUBE |
| 7 | 1 | 228-11-00090 | BUBBLE PUMP ASSEMBLY |

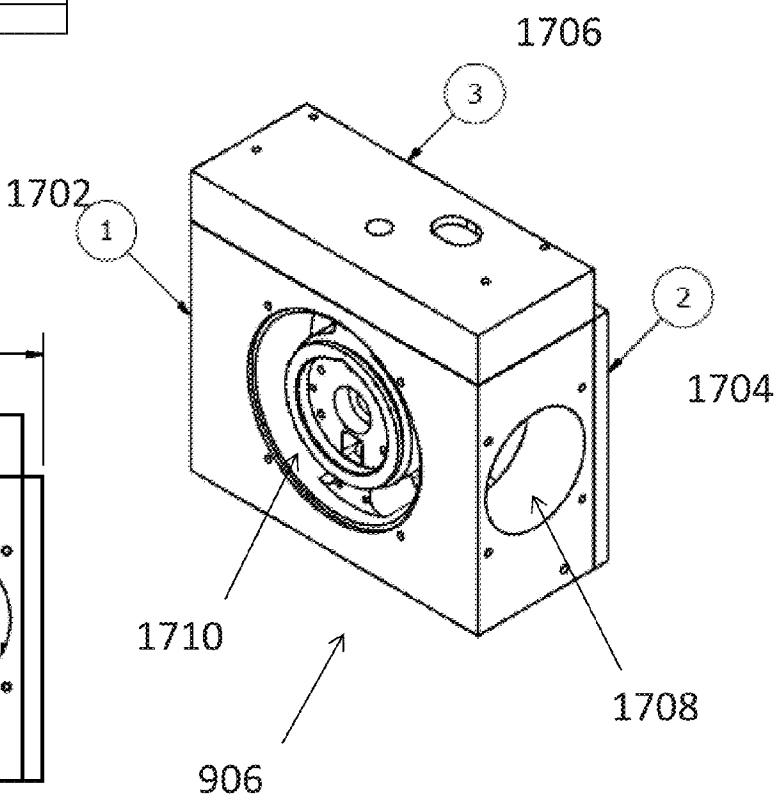
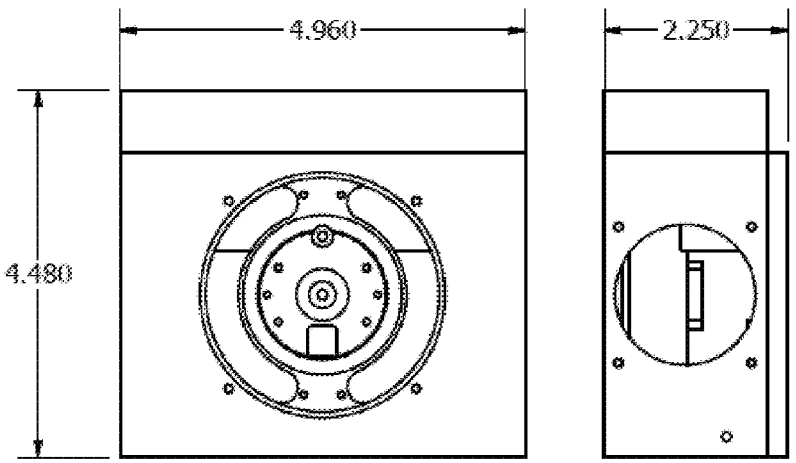
Fig. 17
PARTS LIST
| ITEM | QTY | PART NUMBER | DESCRIPTION |
|---|---|---|---|
| 1 | 1 | 228-05-00002 | BUBBLE PUMP HOUSING |
| 2 | 1 | 228-05-00001 | BUBBLE PUMP BACK PLATE |
| 3 | 1 | 228-06-00010 | FALSE TOP |

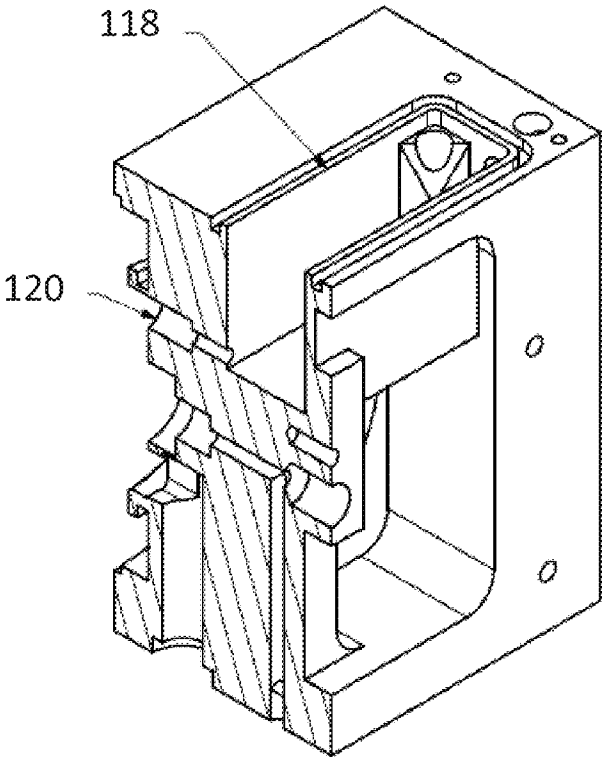
Fig. 20
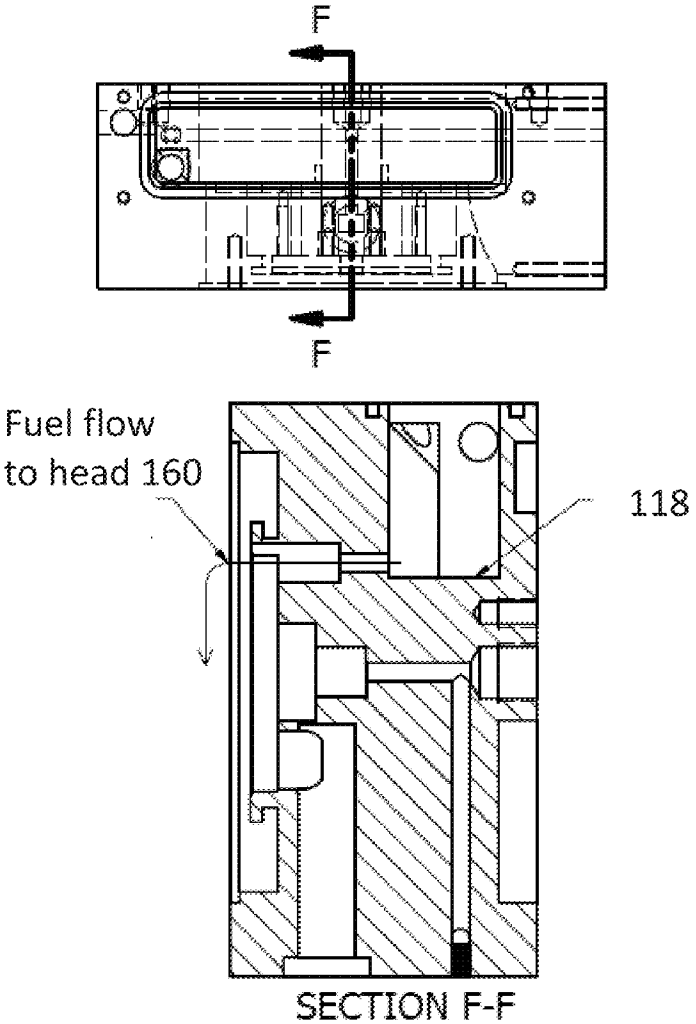

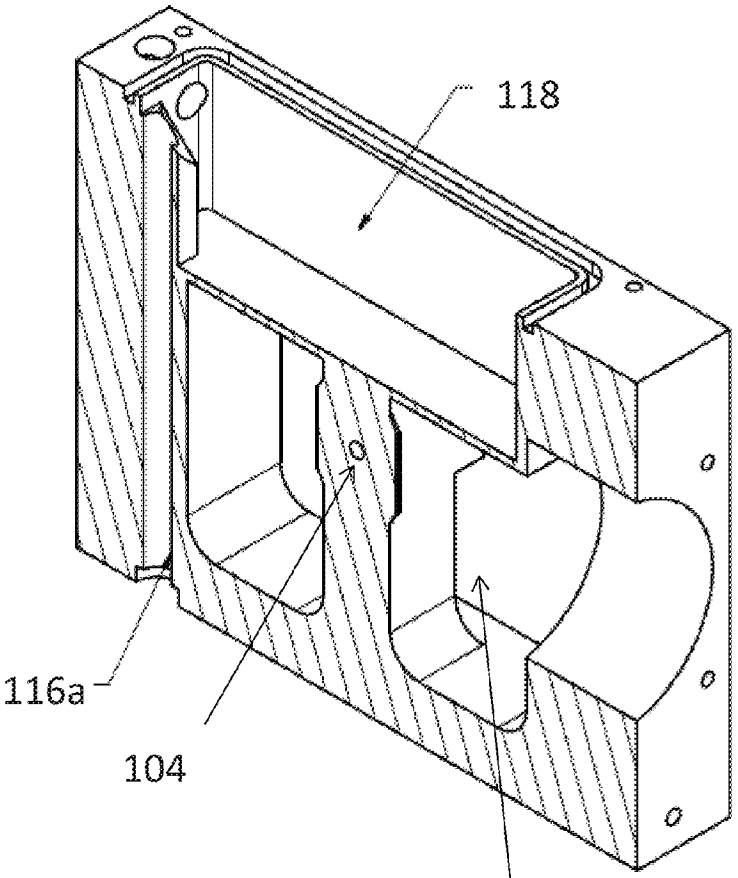
Fig. 23
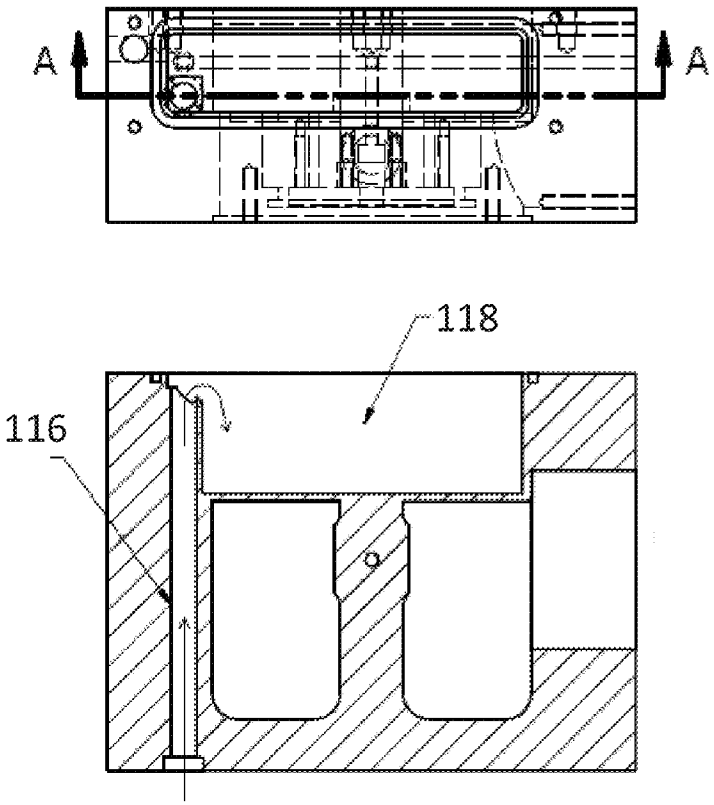
SECTION A-A

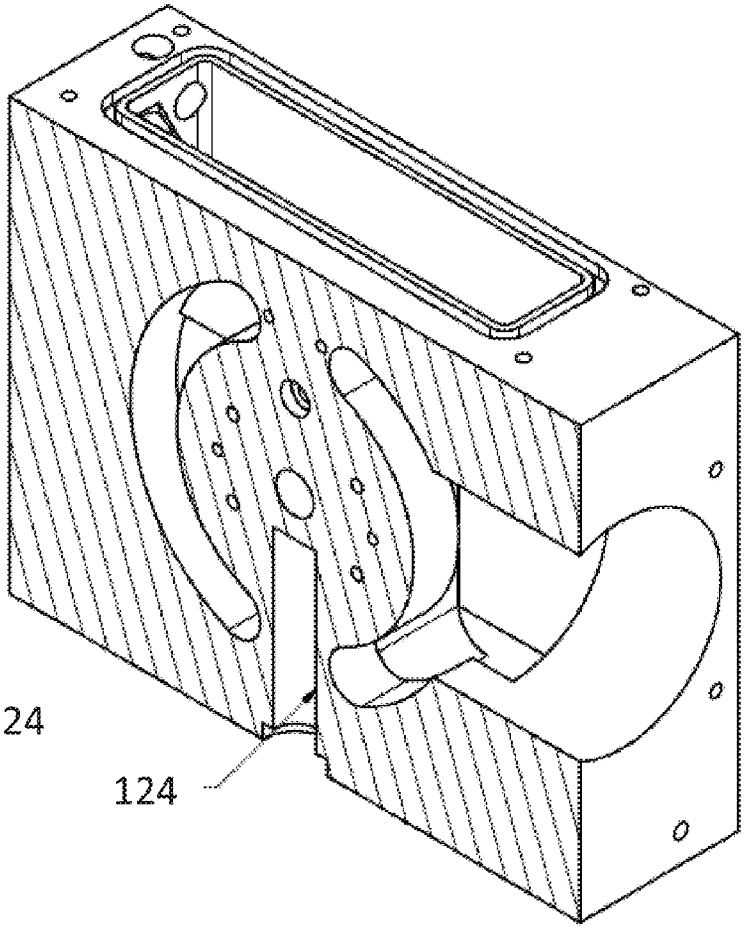
Fig. 24
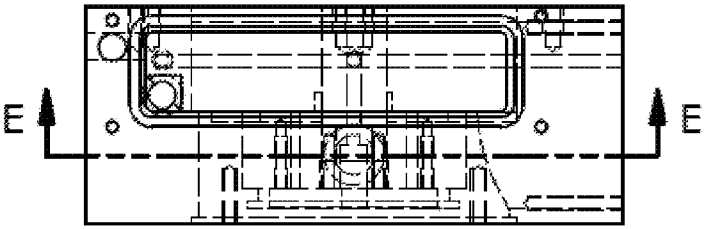
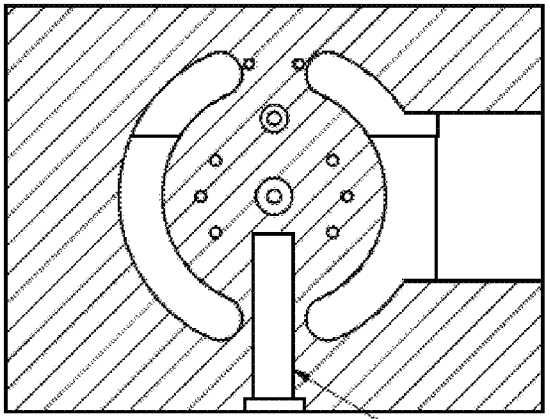
SECTION E-E

FUEL BURNER

FIELD OF THE INVENTION

Embodiments of the present application relates to a fuel burner. More specifically, embodiments of the present invention relate to a simplified burner that utilizes the Babington atomization principle.

BACKGROUND

Fuel burners built consistent with the Babington atomization principle are well known. The methodology mimics the atomization of water over a blowhole of a whale when the whale exhales. In the burner, a thin layer of fuel is poured over a convex surface that has a tiny air hole. Pressurized clean air is forced through the hole, creating a spray so fine that when burned, it creates no smoke, odor or carbon monoxide. By way of non-limiting example, the AIRTRONIC series of burners by BABINGTON TECHNOLOGIES operate on this principle. Non-limiting examples of patents that disclose burners built according to this principle include, e.g., U.S. Pat. No. 4,298,338 entitled LIQUID FUEL BURNERS or U.S. Pat. No. 8,622,737 entitled PERFORATED FLAME TUBE FOR A LIQUID FUEL BURNER, the contents of which are incorporated herein by reference in their entireties, may be used.

The known burners that operate according to the Babington atomization principle utilize separate components to provide air and fuel to the convex surface. These designs thus carry a certain manufacturing cost, a certain degree of maintenance, and a certain minimal power requirement to operate.

BRIEF DESCRIPTION OF THE DRAWINGS

Various embodiments in accordance with the present disclosure will be described with reference to the drawings, in which:

FIG. 13 is an engineering drawing of an embodiment of a burner according to the invention.

FIG. 14 is an engineering drawing of an embodiment of a burner according to the invention.

FIG. 16 is an engineering drawing of an embodiment of a burner according to the invention.

FIG. 17 is an engineering drawing of an embodiment of a burner according to the invention.

FIG. 20 is an engineering drawing of an embodiment of a burner according to the invention.

FIG. 23 is an engineering drawing of an embodiment of a burner according to the invention.

FIG. 24 is an engineering drawing of an embodiment of a burner according to the invention.

DETAILED DESCRIPTION

In the following description, various embodiments will be illustrated by way of example and not by way of limitation in the figures of the accompanying drawings. References to various embodiments in this disclosure are not necessarily to the same embodiment, and such references mean at least one. While specific implementations and other details are discussed, it is to be understood that this is done for illustrative purposes only. A person skilled in the relevant art will recognize that other components and configurations may be used without departing from the scope and spirit of the claimed subject matter.

Figure 1:
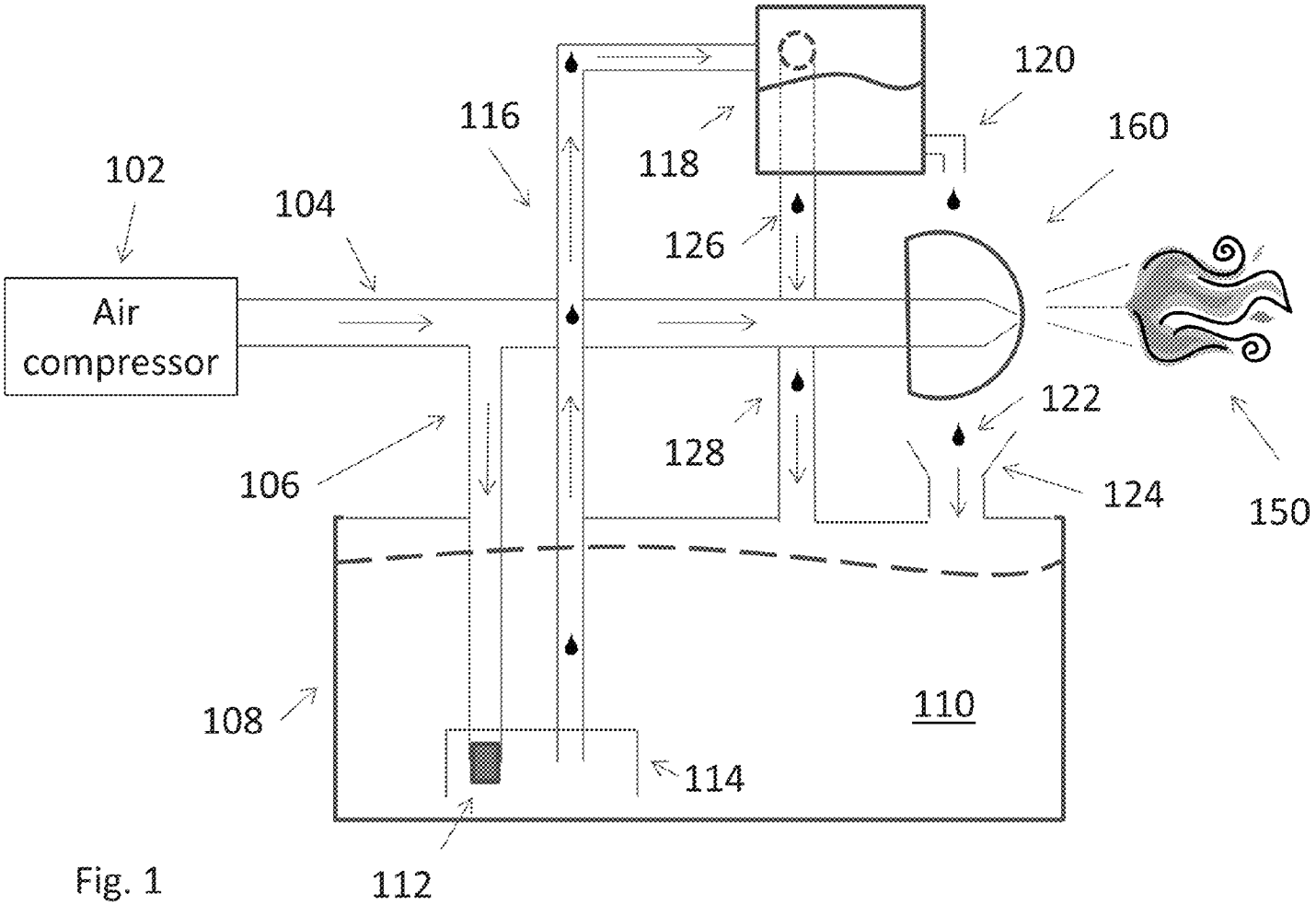
FIG. 1 illustrates a conceptual design of an embodiment of a burner according to the invention.

Referring now to FIG. 1, a conceptual drawing of a burner 100 according to an embodiment of the invention is shown. Various components are connected by various pathways which can communicate air and/or liquid, such that all pathways are to be considered fluid pathways.

An air compressor 102 is provided to deliver clean air and fuel to burner 100. Preferably air compressor 102 is the only moving part and/or electrically powered part within the air and fuel distribution architecture of burner 100.

A first pathway 104 extends from air compressor 102 to an atomizing head 160. Atomizing head 160 has a convex surface with an orifice for spray dispensing fuel consistent with the Babington atomization principle. When fuel is poured over atomizing head 160 (as described below) and ignited, the combusting fuel will generate a flame plume 150 laterally. Air compressor 102 preferably delivers air at sufficient pressure to effectuate this process, e.g., 20 psi. Air compressor 102 may include various controls to control the emitted pressure and/or the temperature of the emitted flame.

A primary fuel tank 108 is provided with fuel 110 for burner 100, and is preferably located such that the top surface of fuel 110 is below atomizing head 160. A second pathway 106 branches off of first pathway 104 into primary fuel tank 108; by this branching air pressure delivered by the air compressor 102 is partially diverted into primary fuel tank 108.

The pressure delivered by air compressor 102 to primary fuel tank 108 via second pathway 106 is preferably substantially lower than the pressure delivered by first pathway 104, e.g., less than 5% of the air pressure provided by air compressor 102 and/or about psi. By way of non-limiting example, this pressure differential between first pathway 104 and second pathway 106 may be achieved by a restrictor 112, such as a screw, that is connected and/or inserted into second pathway 106 to limit the air flow rate into fuel tank 108 containing liquid fuel 110. In another non-limiting example, second pathway 106 could have all or part with a narrow passage to allow minimal air passage. For purposes of brevity, the embodiments below are discussed with reference to a restrictor 112, although the invention is not so limited. Specifically, the invention is not limited to the structure by which the air differential is created between first pathway 104 and second pathway 106.

Figure 15:
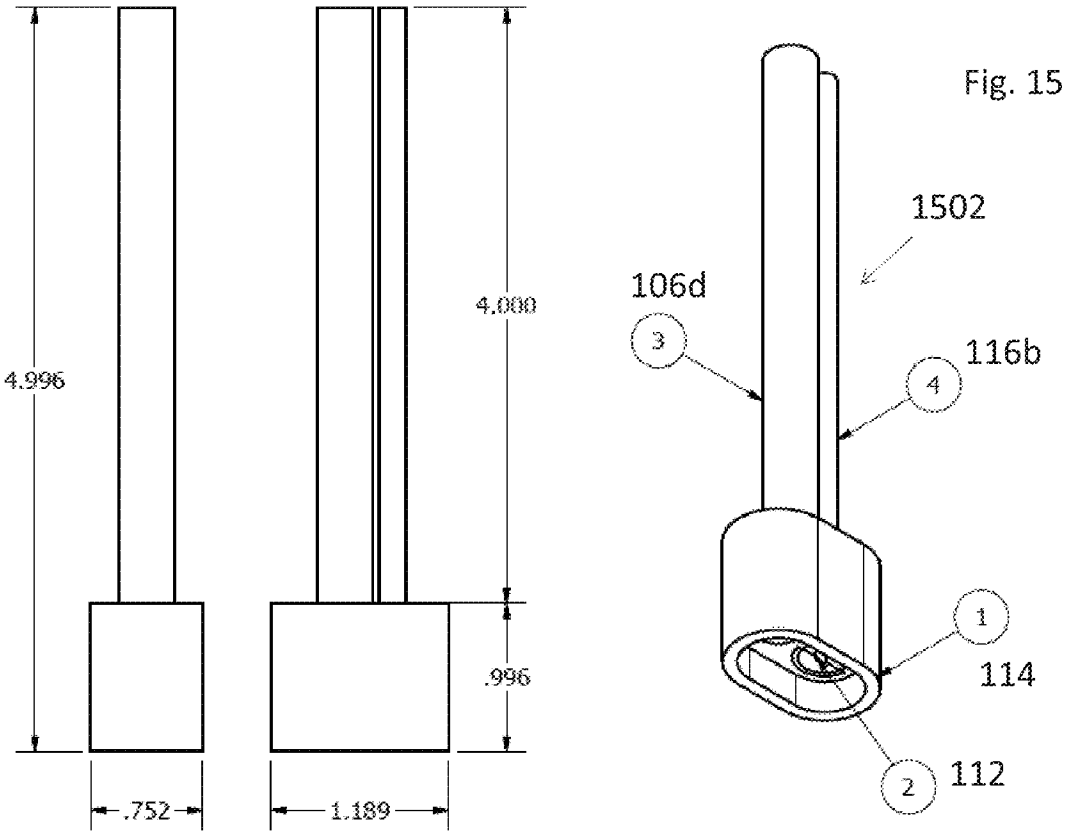
FIG. 15 is an engineering drawing of an embodiment of a burner according to the invention.

Air emitted by second pathway 106 past restrictor 112 into primary fuel tank 108 enters a hooded area 114. Hooded area 114 connects via a third pathway 116 to a secondary fuel tank 118, which is preferably located above atomizing head 160. As air escapes through restrictor 112 into hooded area 114, a mixture of air bubbles and fuel 110 will in turn rise up through third pathway 116 into secondary fuel tank 118. At least a portion of second pathway 106, restrictor 112, hood 114, and at least a portion of third pathway 116 thus collectively form a pump 1502 (FIG. 15). This type of pump is often referred to as a bubble pump or a gas lift pump (collectively "bubble pump"). However, the invention is not so limited to the embodiment shown, and other pumps driven by an air compressor may be used.

Fuel 110 delivered by the bubble pump to secondary fuel tank 118 builds until it reaches the height of a fourth pathway 120. Fourth pathway 120 serves as a fuel delivery spout to the atomizing head 160. Fuel 110 delivered by fourth pathway 120 can be subsequently ignited and spray dispersed by the air from air compressor 102 as described above.

The amount of fuel delivered by fourth pathway 120 to atomizing head 160 may exceed the amount that is actually ignited by burner 100. Excess fuel 122 falls by gravity into a sixth pathway 124 which directs the excess fuel 122 back into primary fuel tank 108.

For optimal performance, atomizing head 160 needs a steady fluid flow to provide a consistent flame. Direct delivery of fuel 110 from the bubble pump through third pathway 116 to atomizing head 160 is not optimal because the fuel flow tends to be sporadic. Secondary fuel tank 118 thus acts as an intermediate fuel gathering location. When the pathways are designed such that fuel flows into secondary fuel tank 118 via the third pathway 116 faster than it leaves via a fourth pathway 120, the fuel will always output steady from fourth pathway 120 once it reaches a minimum height, regardless of the sporadic nature of the input fuel flow into secondary tank 118 via third pathway 116.

If the rate of fuel input into secondary fuel tank 118 exceeds the rate of fuel output via fourth pathway 120, the amount of fuel in secondary fuel tank 118 may eventually exceed capacity. A fifth pathway 128 thus extends from a point above fourth pathway 120 toward primary fuel tank 108. Fifth pathway 128 provides an outlet for any excess fuel 126 in secondary fuel tank 118 to return to primary fuel tank 108.

In the above embodiment both the provision of air for combustion and the fuel dispensing system are driven by a single common air compressor 102. Compared to other prior art designs, this embodiment has less moving parts, with resulting reduced costs in manufacture and maintenance. The use of a single air compressor 102 also reduces the power requirements needed to drive burner 100, thus making it particularly useful in environments in which power may be at a premium. For example, the entire burner 100 may run based on about 6 watts of power, which can be provided by an attached solar cell. This embodiment may have particular humanitarian applications in areas that lack consistent access to electricity and or repair facilities.

The conceptual design of FIG. 1 may be implemented using various known structures for air compressor 102 primary and secondary fuel tanks 108 and 118, and atomizing head 160. The various fluid pathways may be constructed from hoses, pipes, or segments thereof connected together in a known manner. In the alternative, the various pathways could be drilled through solid material, such as a steel block. In yet another alternative, the various pathways could be partially defined in opposing blocks that form the pathways when the blocks are connected together. Combinations of the above, as well as other connection forming techniques may be used.

Figure 2:
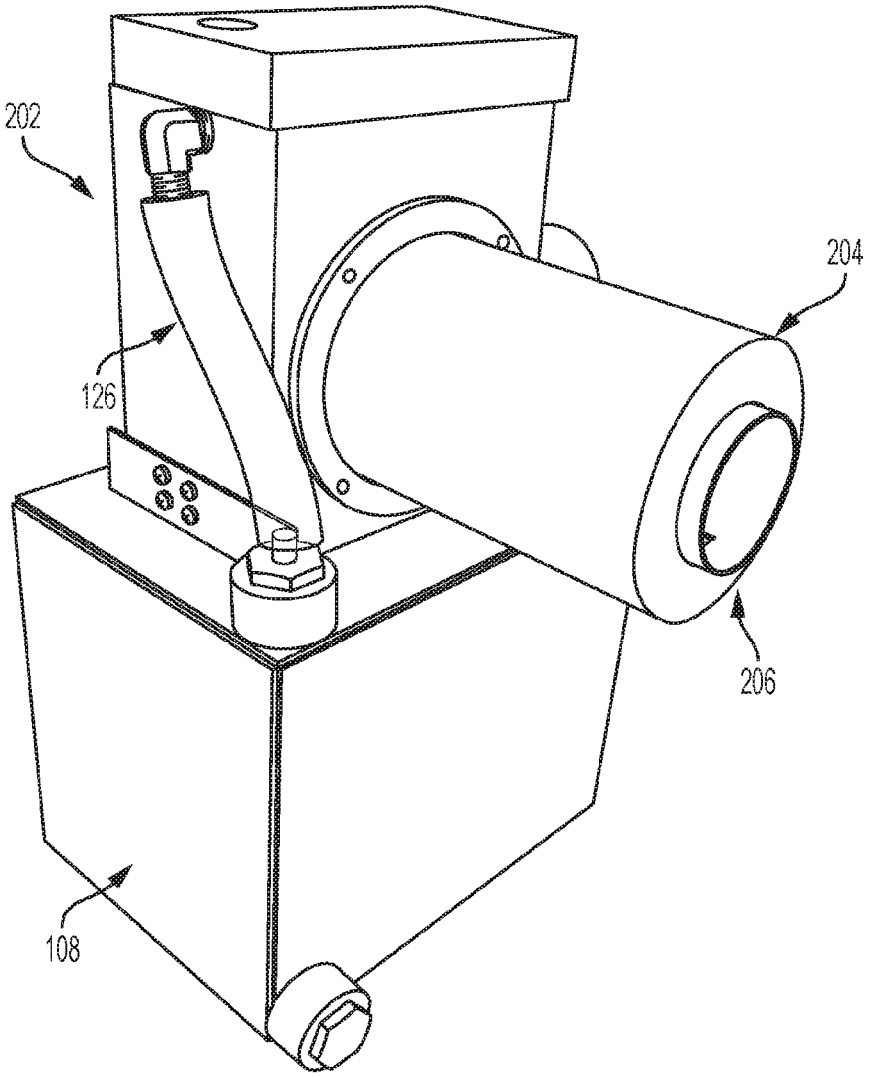
FIG. 2 is a perspective view of an embodiment of a burner according to the invention.
Figure 3:
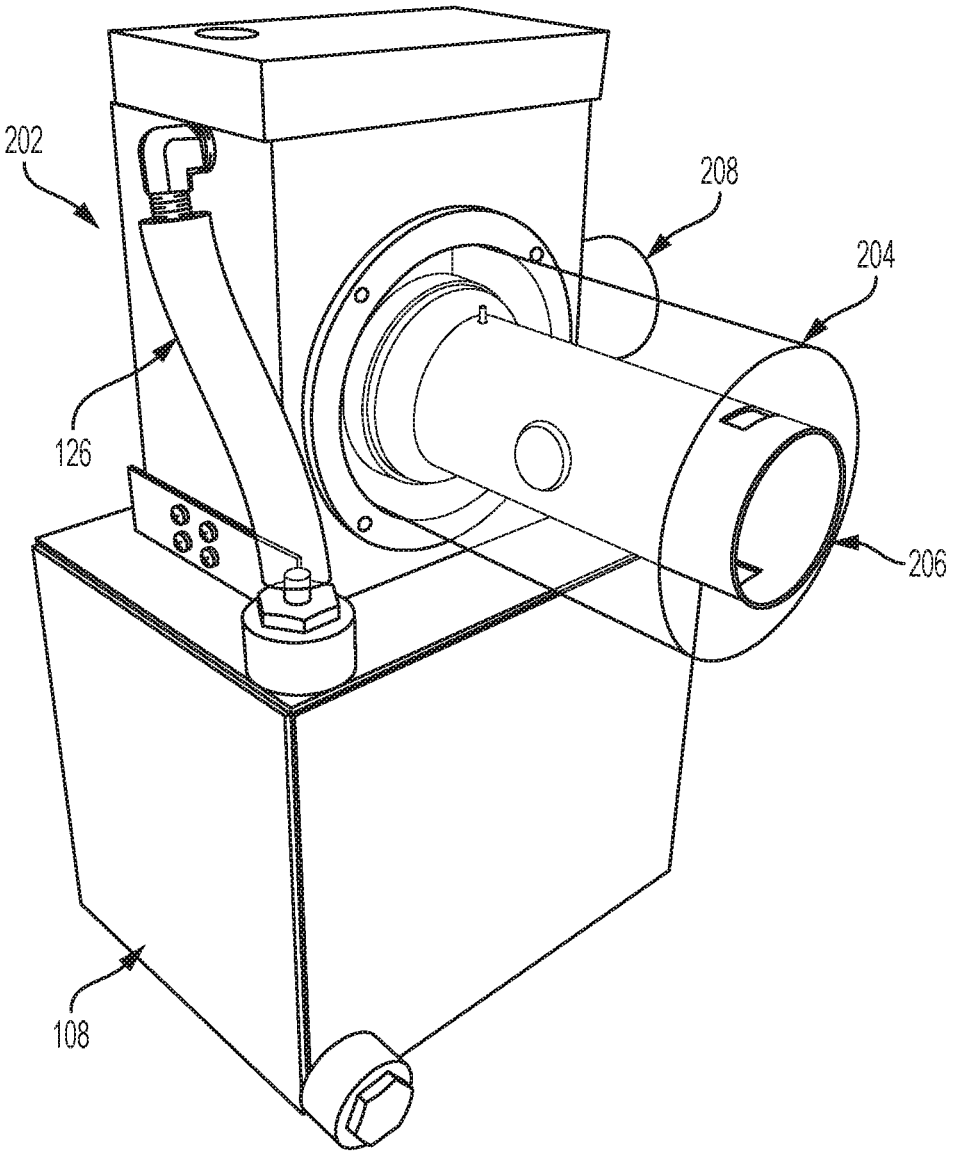
FIG. 3 is perspective partial cutaway view of an embodiment of a burner according to the invention.
Figure 4:
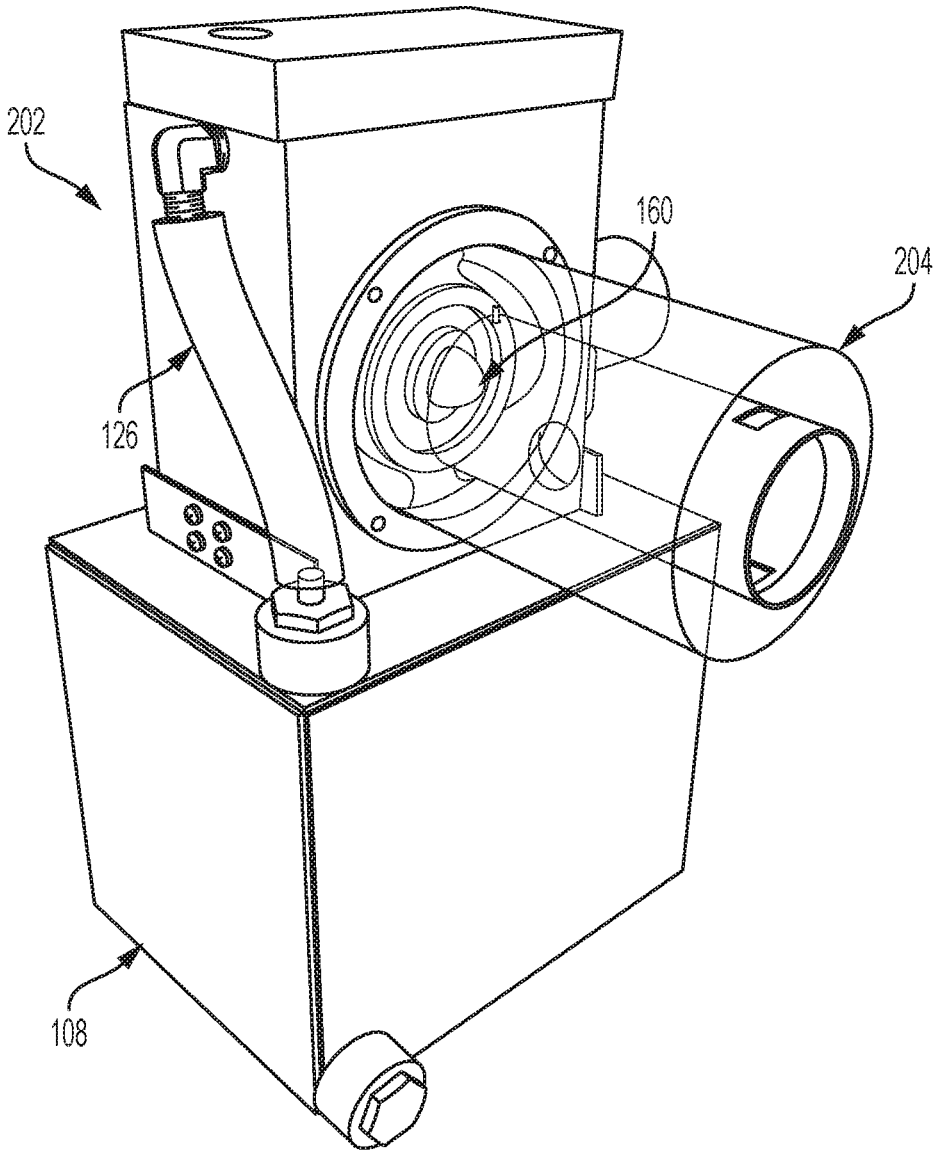
FIG. 4 is perspective partial cutaway view of an embodiment of a burner according to the invention.

Referring now to FIG. 2, various components described in FIG. 1 as above primary fuel tank 108 may be housed in and/or defined by an upper shell 202. In this embodiment fifth pathway 128 is an exterior tube that connects from fuel tank 108 to fuel tank 118 (not visible in FIG. 2). An air tube 204 surrounds a flame tube 206 to channel flame plume 150 (not visible in FIG. 2). FIGS. 3 and 4 show air tube 204 and flame tube 206 partially removed, such that atomizing head 160 is visible. A fan 208 injects air into the vicinity of atomizing head to provide air for the combustion of the fuel in flame plume 150.

Figure 5:
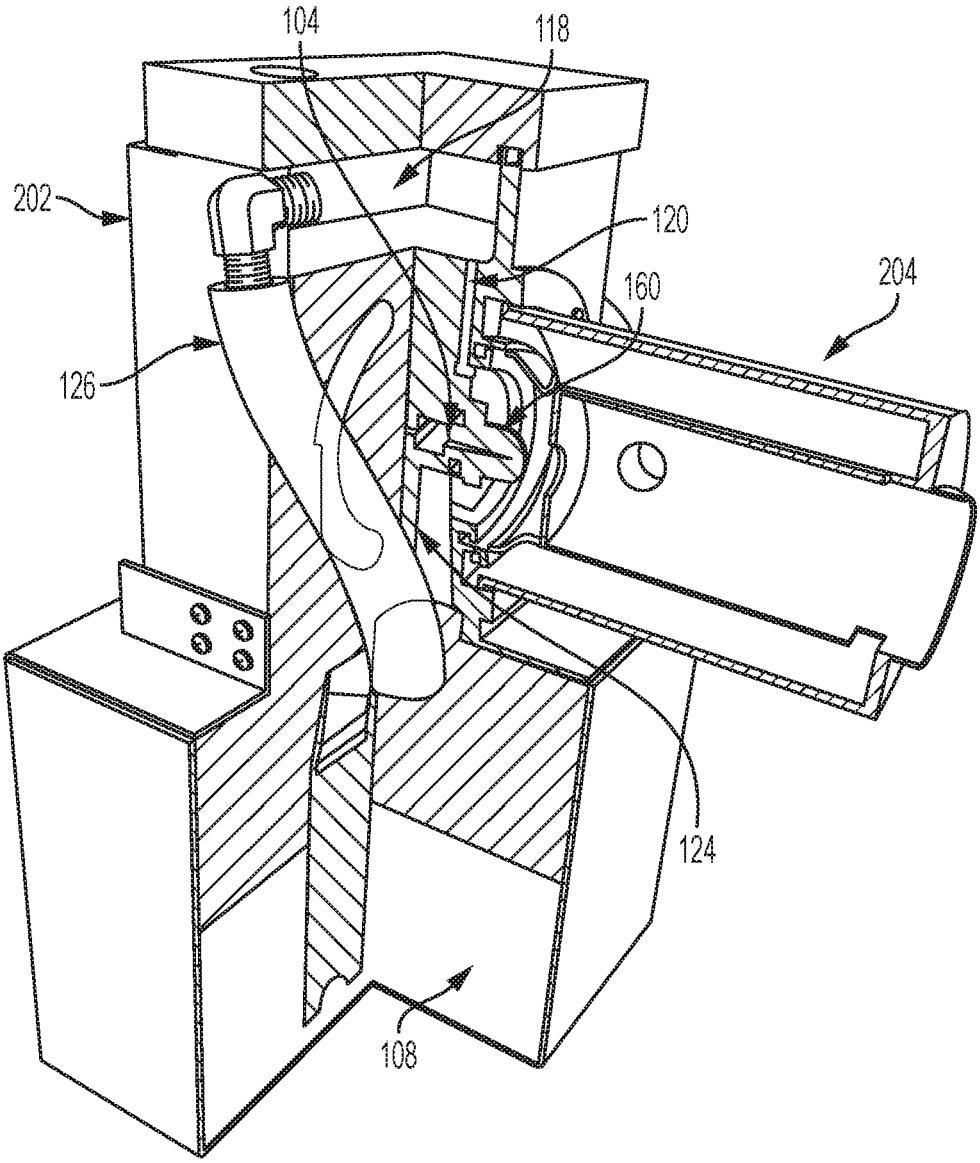
FIG. 5 is perspective partial cutaway view of an embodiment of a burner according to the invention.

Referring now to FIG. 5, the cross section shows the second fuel tank 118, the fourth pathway 124 that delivers fuel from second fuel tank 118 to atomizing head 160, the receiving area 124 that catches excess fuel off of atomizing head 160 and delivers it to primary fuel tank 108. Part of first pathway 104 that connects directly to atomizing head 160 can also be seen.

Figure 6:
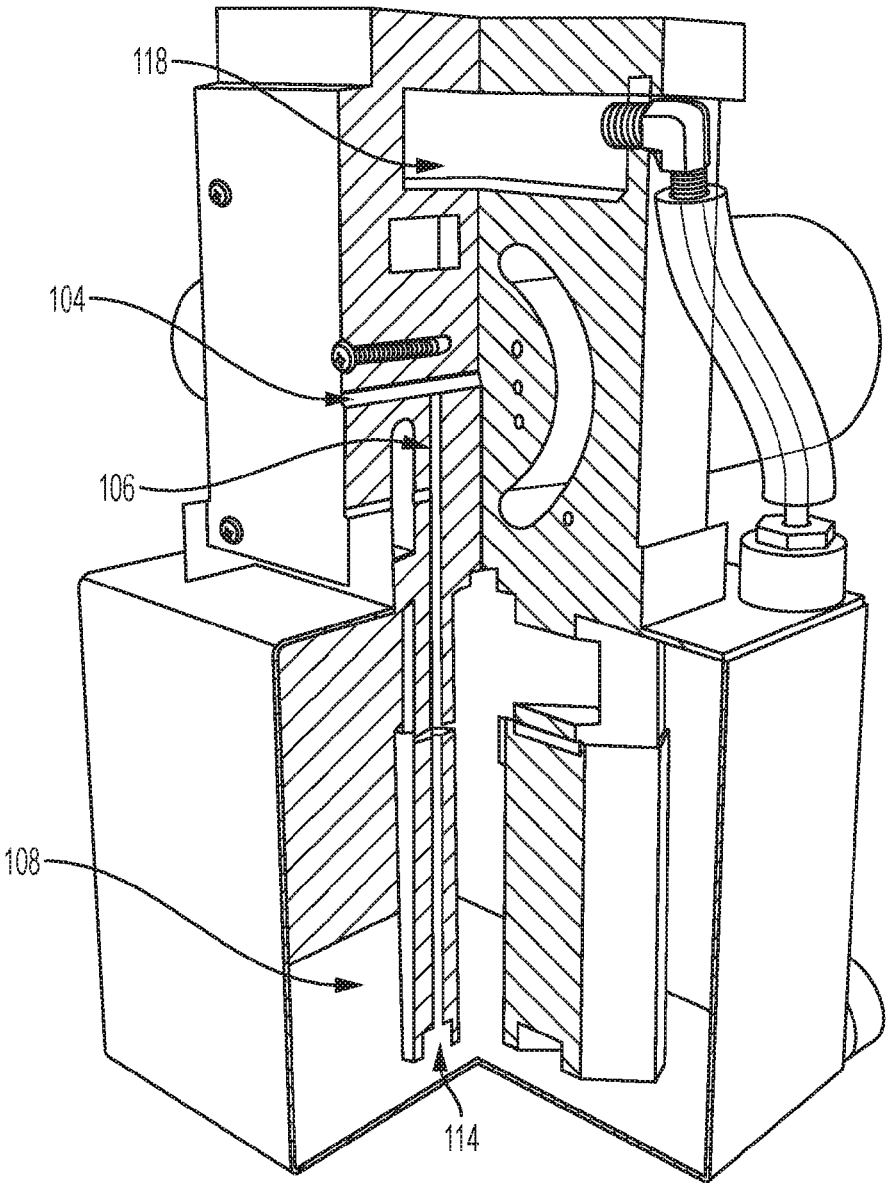
FIG. 6 is perspective partial cutaway view of an embodiment of a burner according to the invention.

Referring now to FIG. 6, the cross section shows the first fuel tank 108 and second fuel tank 118, a portion of the first pathway 124 that delivers air to atomizing head 160, the second pathway 106, and hood 114.

Figure 7:
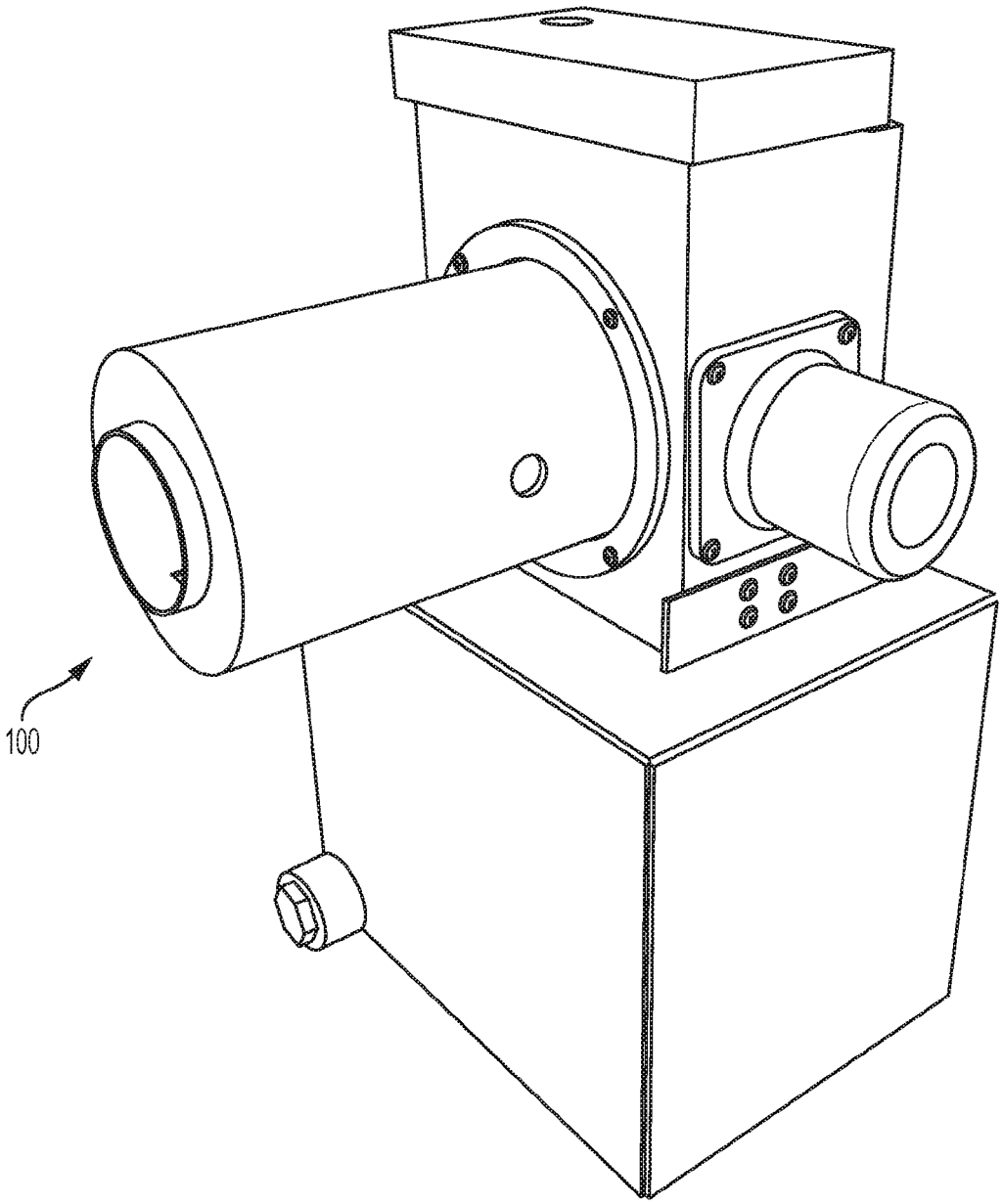
FIG. 7 is a perspective view of an embodiment of a burner according to the invention.
Figure 8:
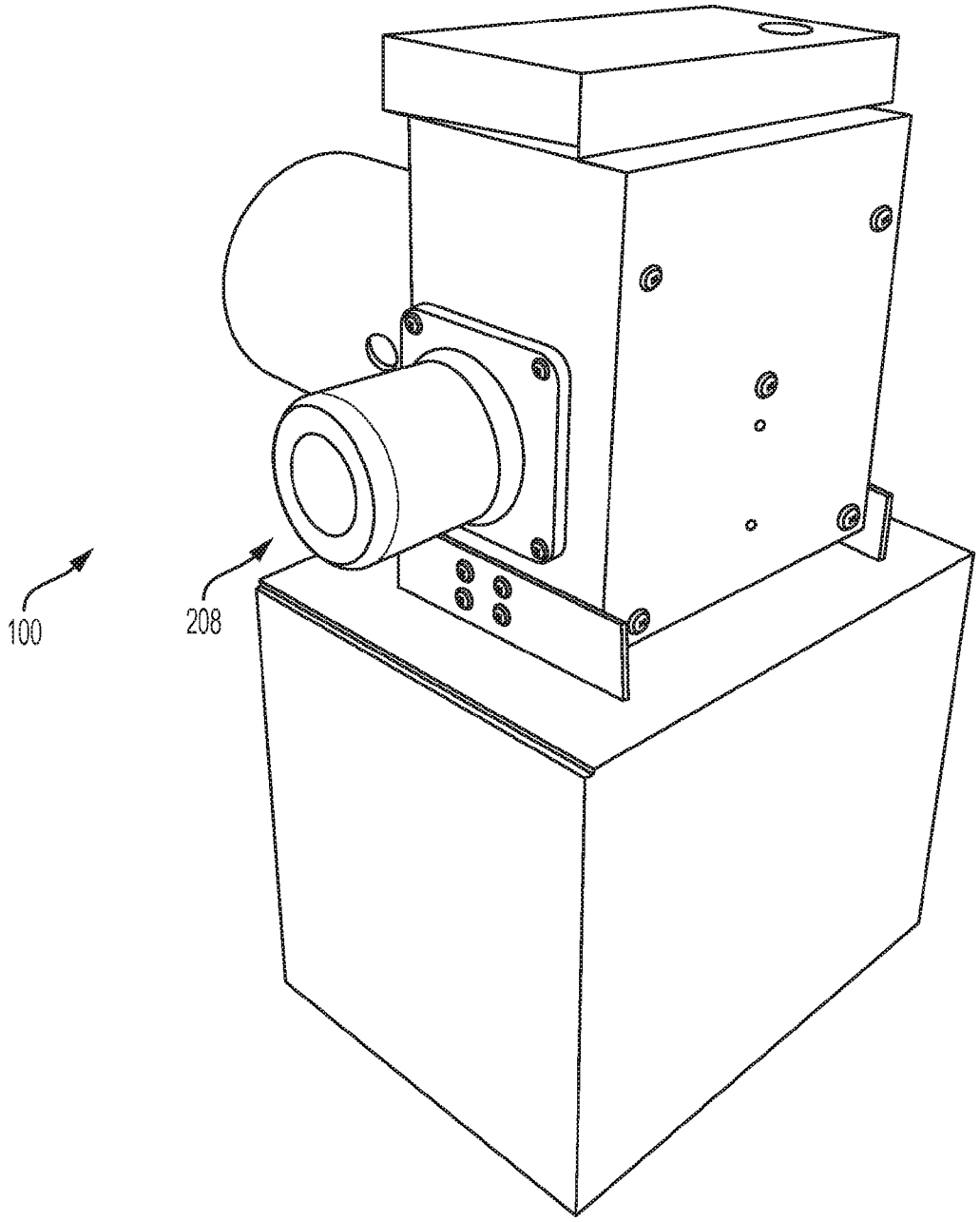
FIG. 8 is a perspective view of an embodiment of a burner according to the invention.

FIGS. 7 and 8 show exterior views of the burner 100 without its compressor 102.

Figure 9:
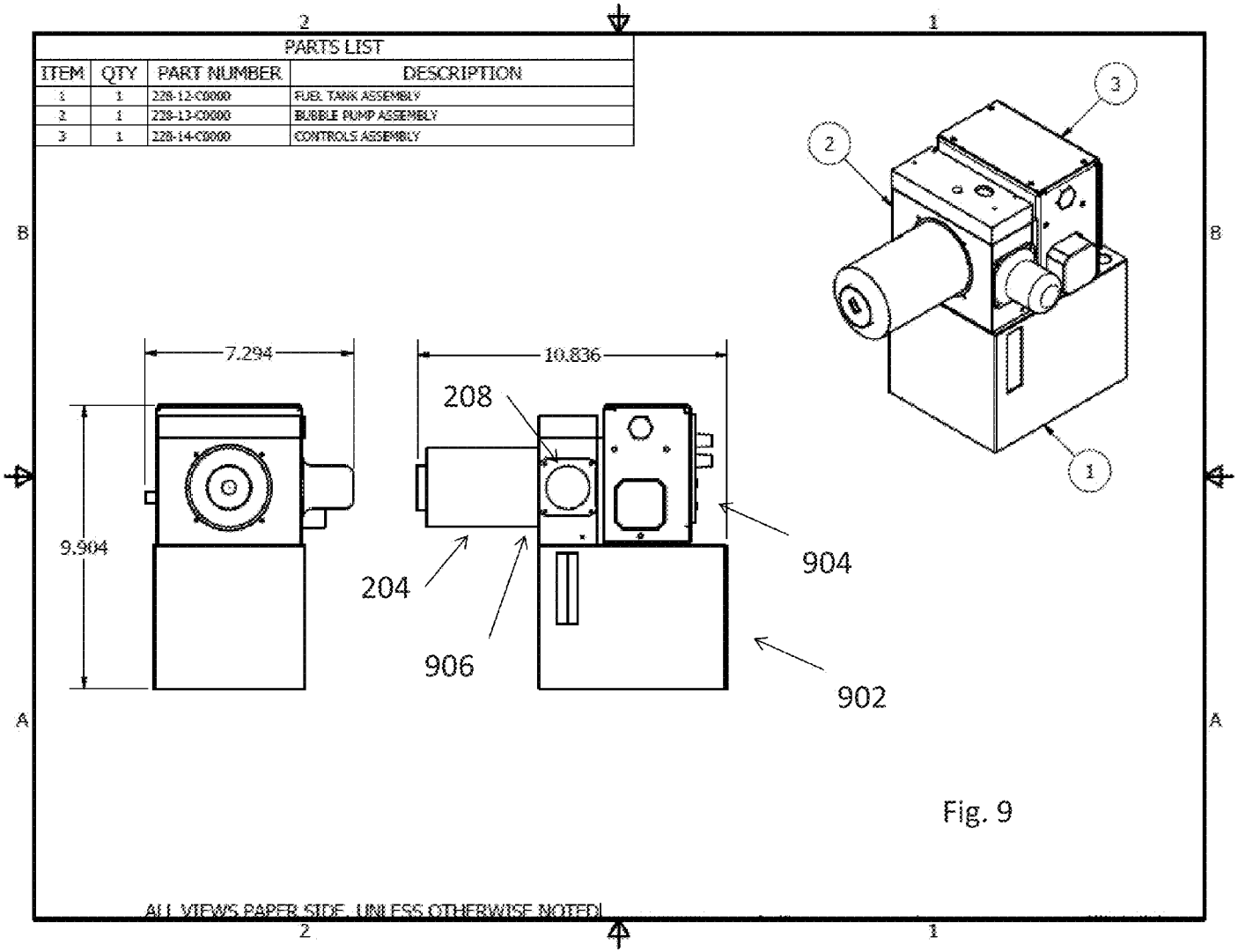
FIG. 9 is an engineering drawing of an embodiment of a burner according to the invention.

Referring now to FIG. 9, the above embodiment is generally distributed into three separate components: primary fuel section 902, compressor section 904, and pump section 906.

Figure 10:
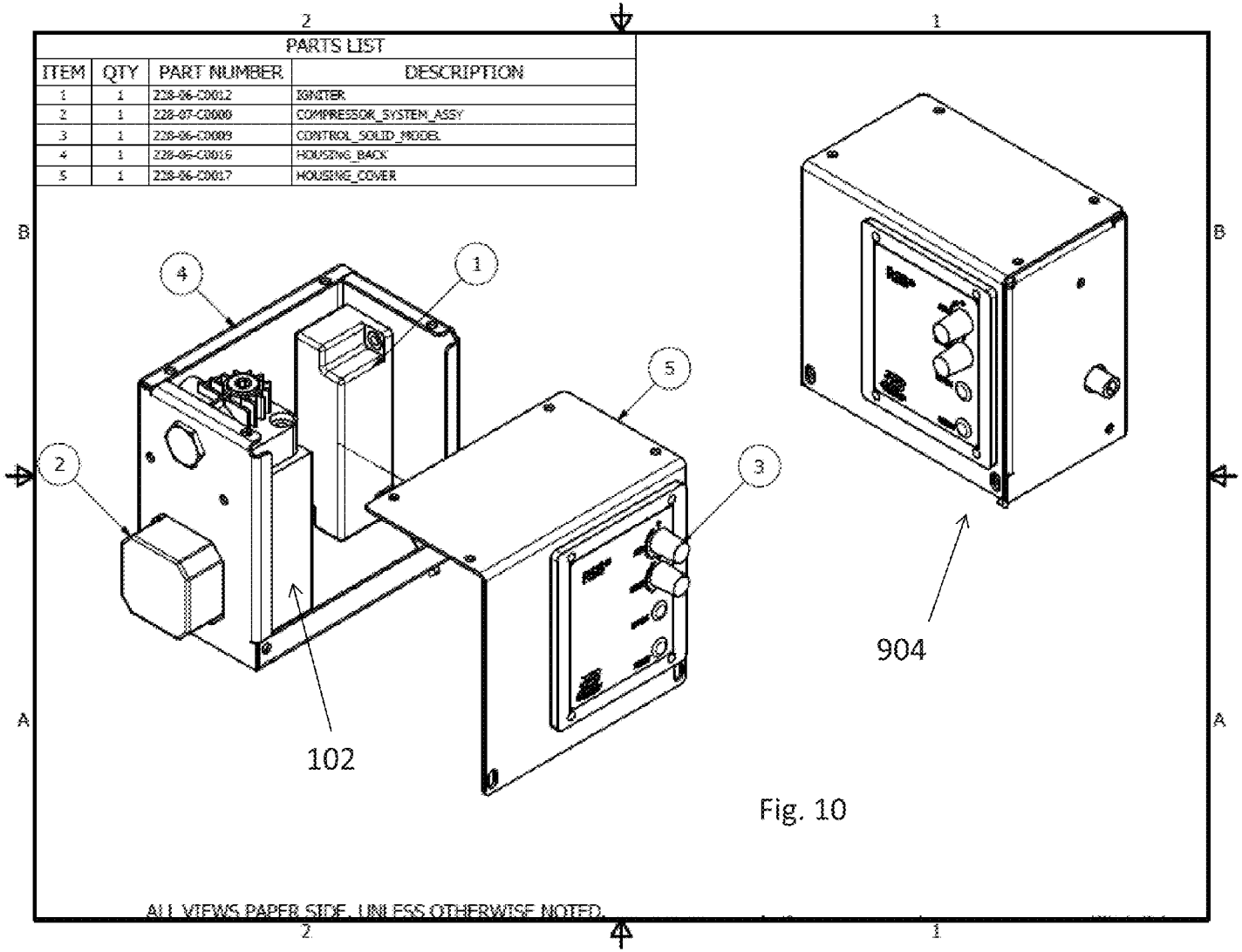
FIG. 10 is an engineering drawing of an embodiment of a burner according to the invention.
Figure 11:
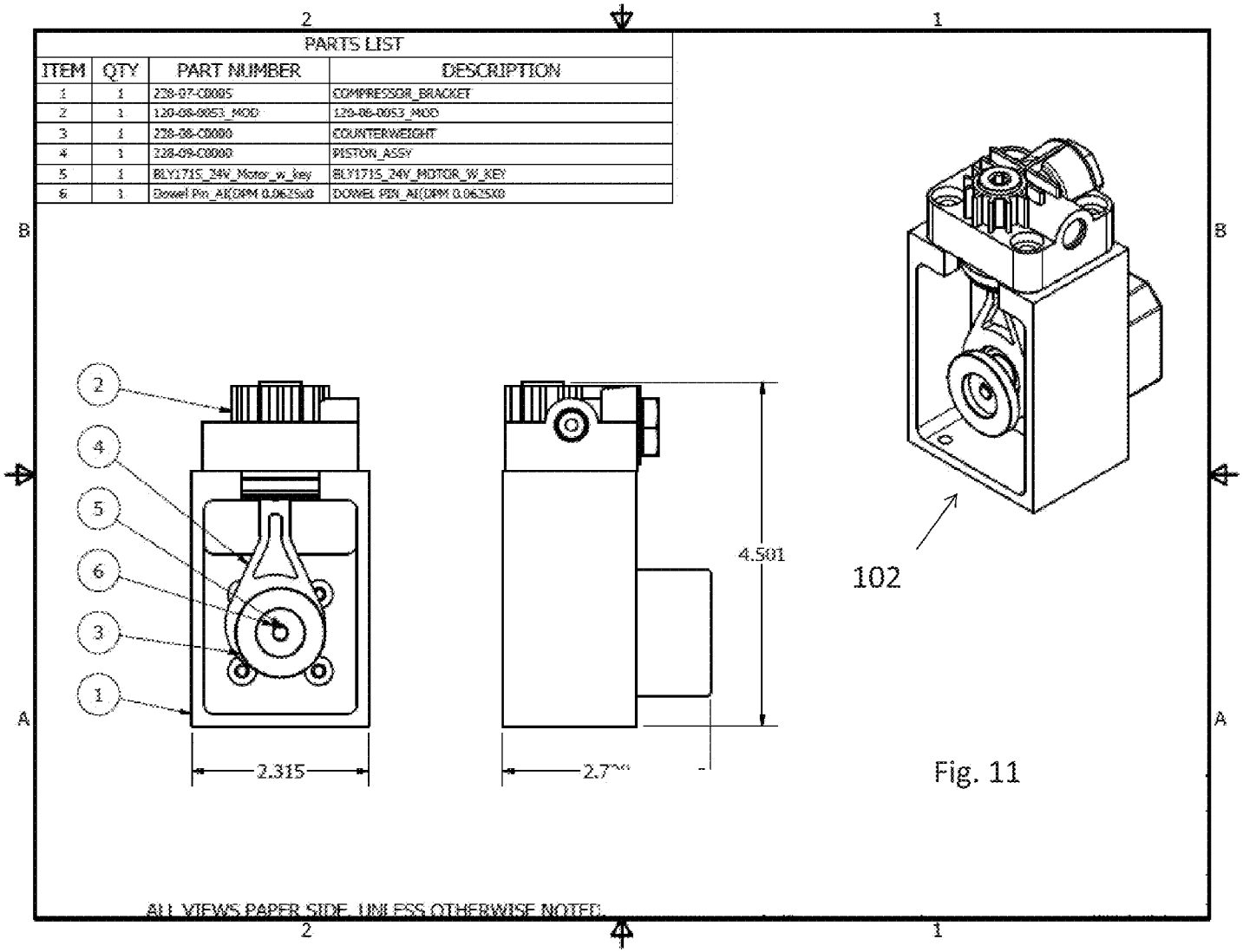
FIG. 11 is an engineering drawing of an embodiment of a burner according to the invention.
Figure 12:
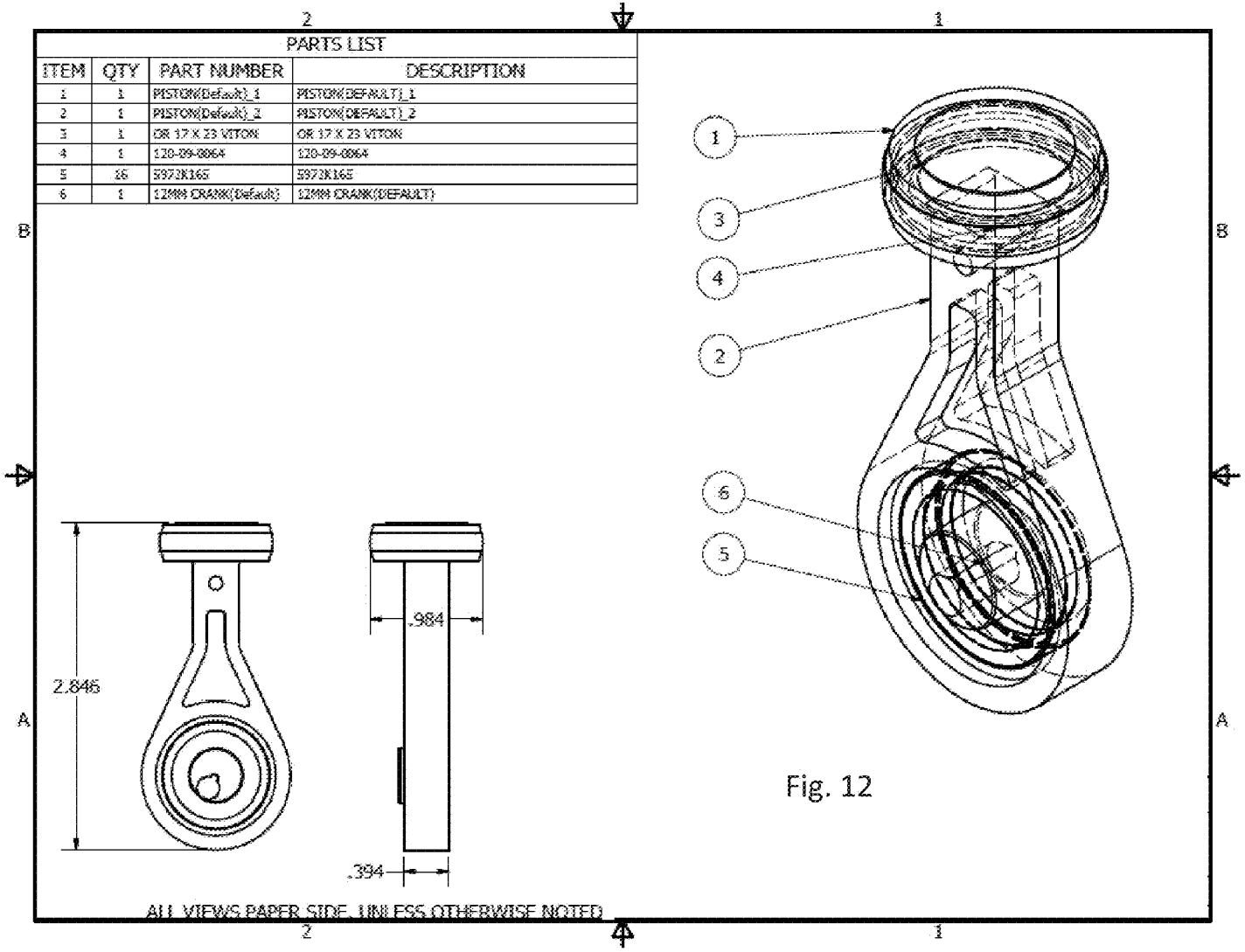
FIG. 12 is an engineering drawing of an embodiment of a burner according to the invention.
Figure 25:
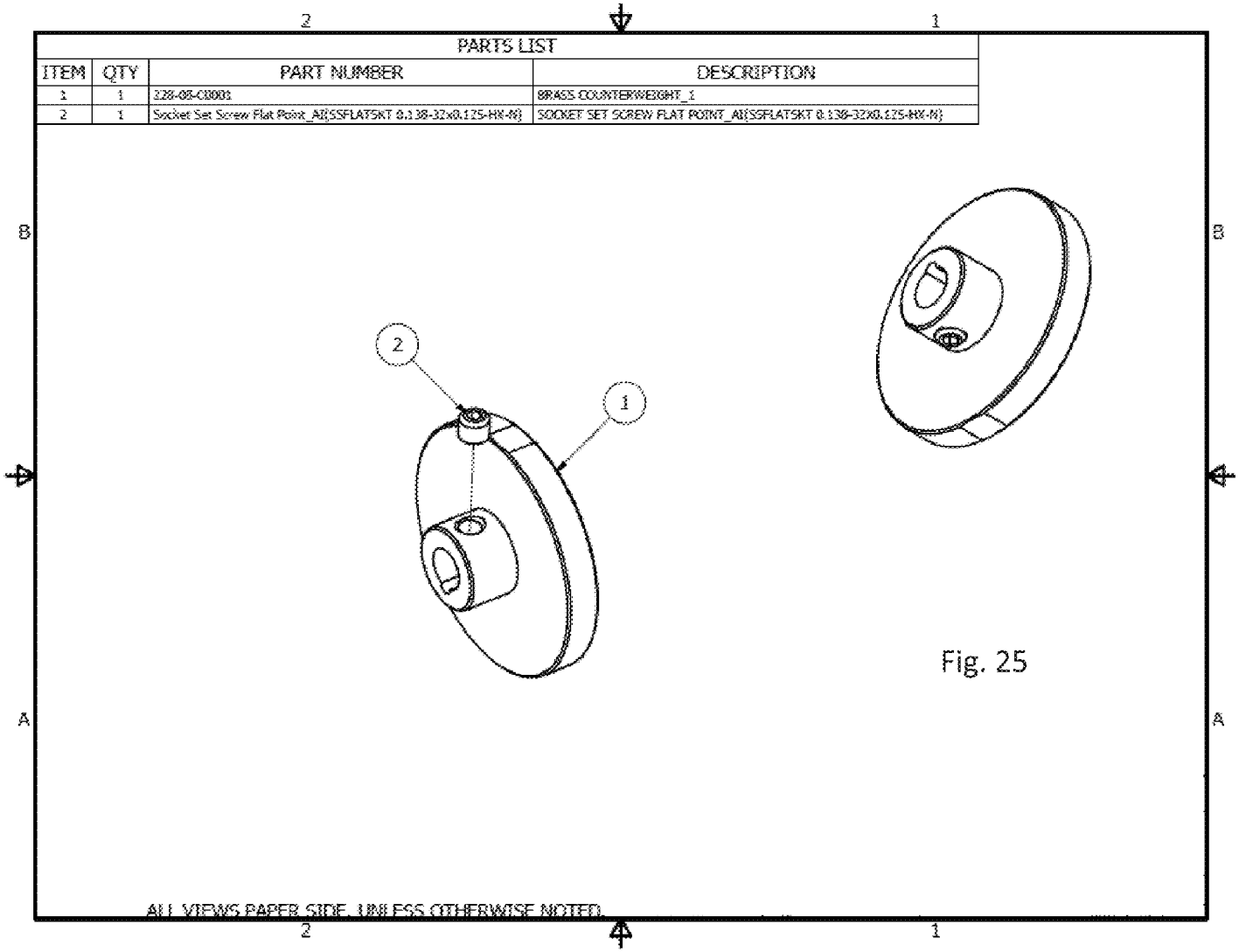
FIG. 25 is an engineering drawing of an embodiment of a burner according to the invention.

Referring now to FIG. 10, compressor section 904, which includes compressor 102, is generally shown. FIGS. 11 and 25 illustrate components inside compressor 102.

Referring now to FIG. 13, primary fuel section 902 is shown, which includes primary fuel tank 108. An opening 1302 allows for insertion of the bubble pump components. An opening 1304 allows for return fuel via pathway 128. An opening 1306 provides a pathway to drain the fuel 10 out of the fuel tank 108. Windows 1312 permit visual inspection of the amount of fuel inside fuel tank 108.

Referring now also to FIG. 14, the bubble pump preferably has a minimum depth below the level of fuel 110 to ensure optimal operation. As shown in FIG. 1, fuel tank 108 can compass the entirety primary fuel section 902; this will provide sufficient fuel for the depth of the bubble pump, but may also be more fuel than necessary to run burner 100. FIGS. 13 and 14 show another embodiment in which the base of fuel tank 108 terminates above the bottom of primary fuel section 902 save for a well 1310, thus defining a lower chamber 1308. Fuel fills fuel tank 108 and its well 1310; the bubble pump components are then inserted into the well 1310. When there is some fuel visible in the window 312, then there will be sufficient fuel in well 1310 to support the operations of the pump.

FIG. 15 shows an embodiment of a bubble pump that can be used in the invention. The pump includes a lower portion 116*b* of third pathway 116, and a lowermost portion 106*d* of second pathway 106. Hood 114 covers both and restrictor 112 is inserted into the second pathway 106.

FIG. 16 shows an embodiment of pump section 906 with attachments. This embodiment reflects a design concept that at least some of the various fluid pathways within pump section 206 can be machined from solid components (such as a block of stainless steel), and chambers formed by connecting such components together.

Figure 18:
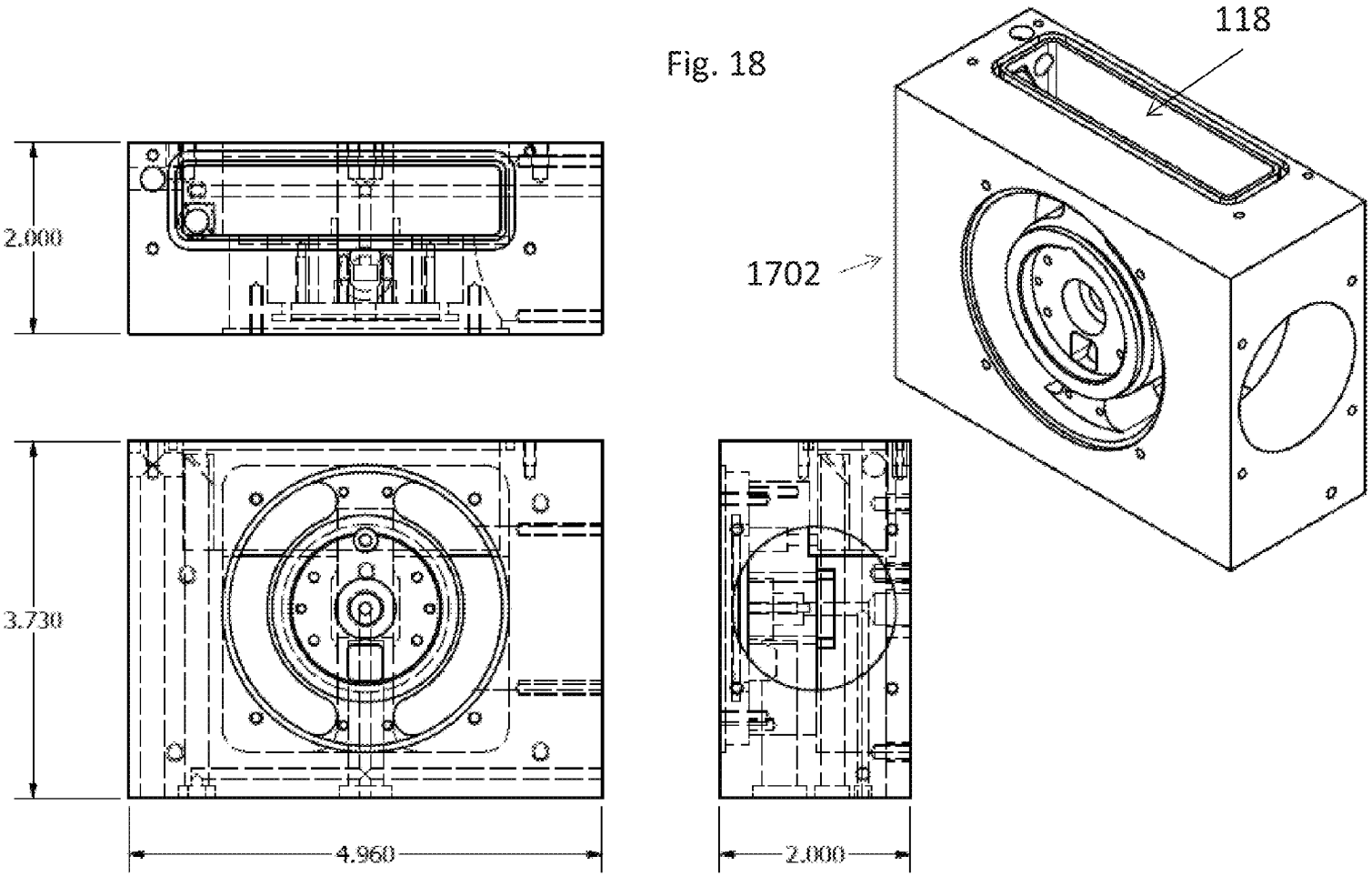
FIG. 18 is an engineering drawing of an embodiment of a burner according to the invention.

Referring now also to FIGS. 17 and 18, pump section 906 is made from three machined sections, including a main section 1702, a back plate 1704, and a top plate 1706. A side opening 1708 connects to fan 208 (FIG. 8) to inject air into an interior cavity 2002 (FIG. 20) of pump section 906. The air emerges through front opening 1710 to provide oxygen for combustion with atomized fuel dispensed from head 160.

Figure 19:
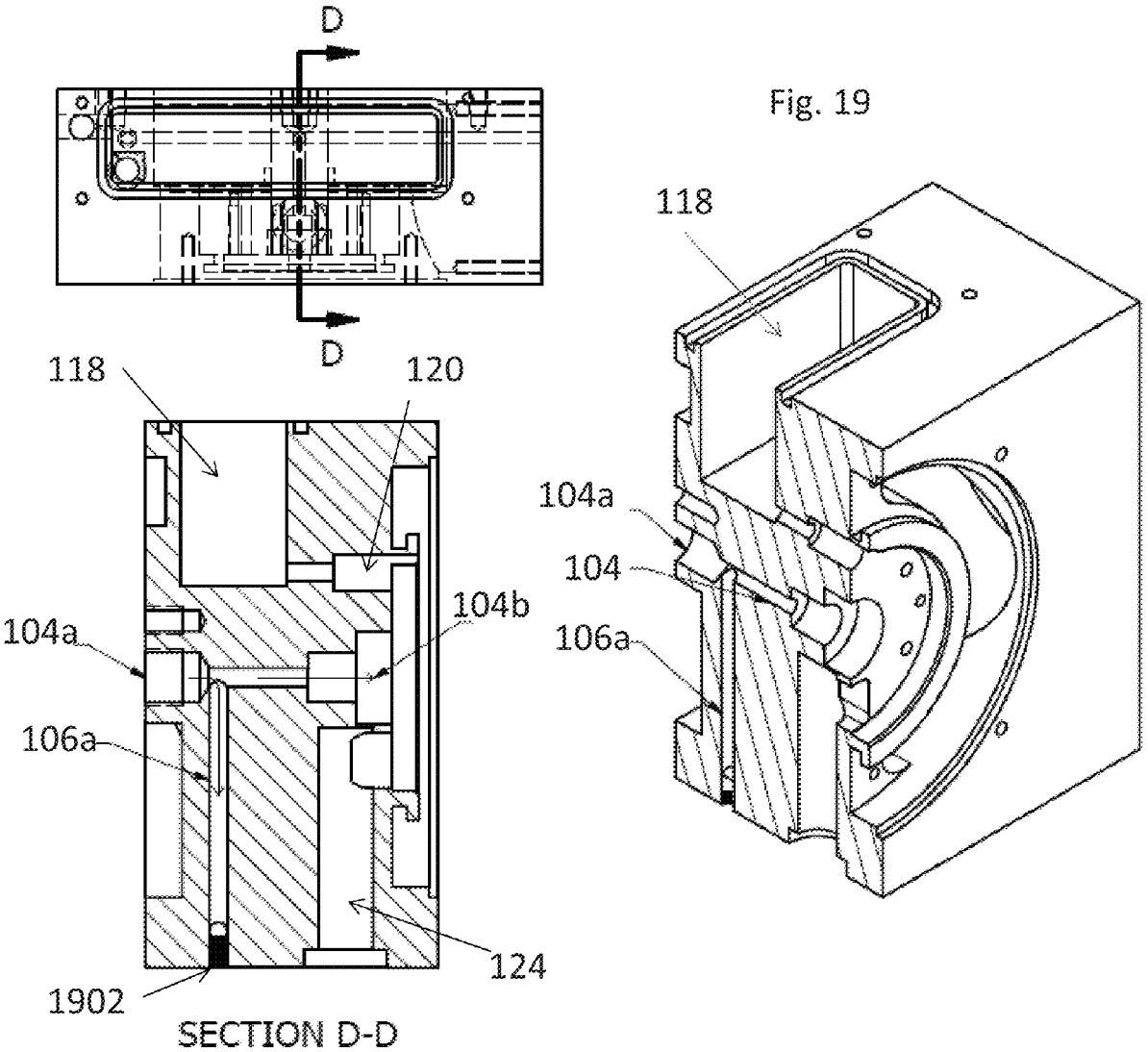
FIG. 19 is an engineering drawing of an embodiment of a burner according to the invention.

Referring now to FIGS. 19 and 20, these lateral cross sectional views show how main section 1702 of pump section 906 can be formed by machining out a block of metal to form the various structures defined herein. Second fuel tank 118 is defined by a hollowed out cavity in the top of the block and later covered by top plate 1706. Fourth pathway 120 is defined by a drilled hole extending from above the atomizing head 160 into secondary fuel tank 118. Sixth pathway 124 is defined by a drilled hole extending from below the atomizing head 160 to the base of the block, which is located over primary tank 108 and allows excess fluid to circulate as described above. The full length of first pathway 104, along with an inlet 104*a* and outlet 104*b*, are drilled straight through. An upper portion 106*a* of second pathway 106 is defined by drilling a hole into the block that intersects first pathway 104, to intersect another drill hole (not shown) and is capped by epoxy 1902 to form a "turn" (discussed below). The various pathways may have different sizes and shapes along their lengths, which may in part be achieved by different size machine tools.

Figure 21:
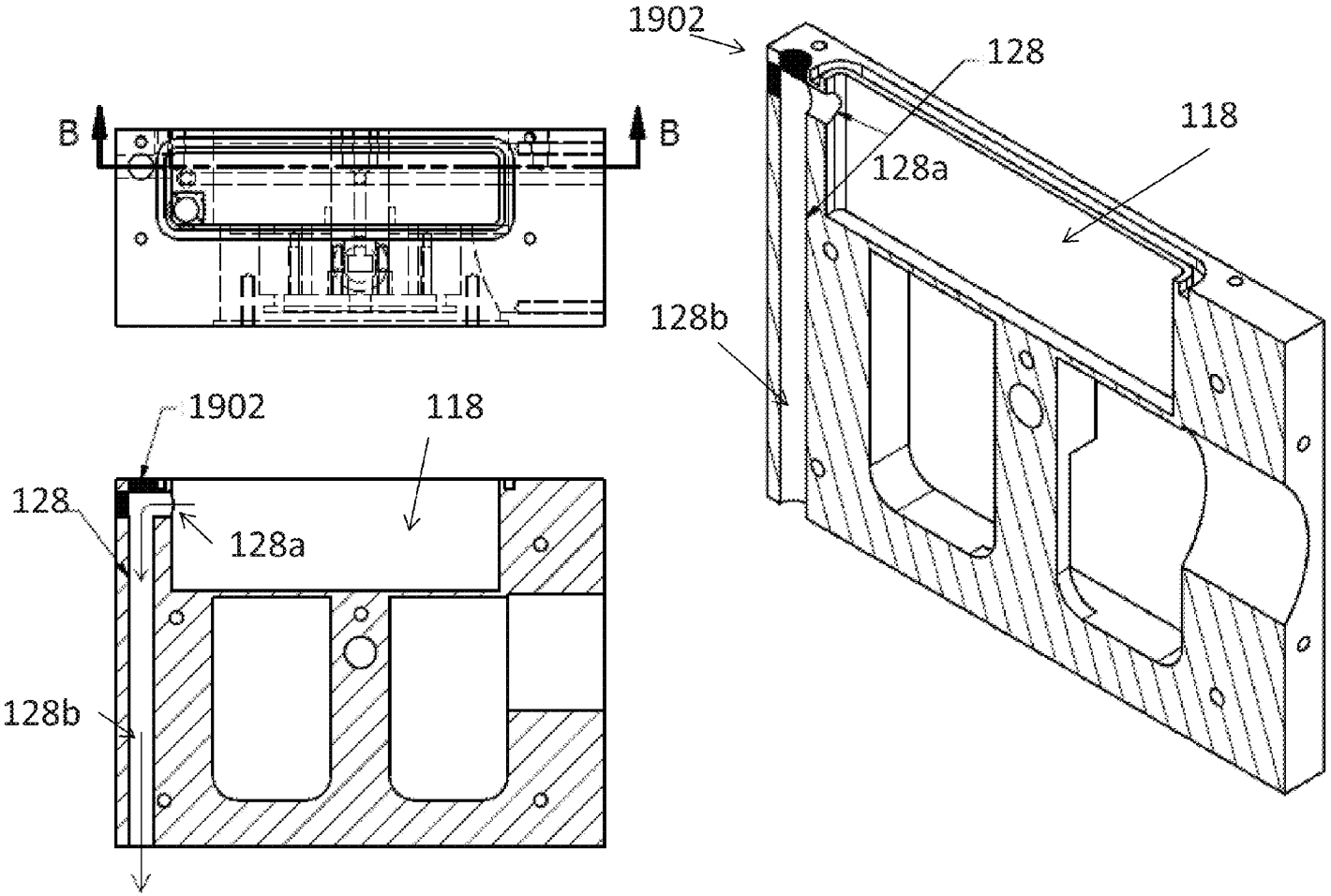
FIG. 21 is an engineering drawing of an embodiment of a burner according to the invention.

FIGS. 21-24 are longitudinal cross section views taken at different lengths of the block to show the nature of various pathways. Referring now to FIG. 21, the cross section is generally aligned with the fifth pathway 128 as machined into the block (compared to the tube version of fifth pathway 128 in, e.g., FIG. 3). The fifth pathway is defined by two intersecting drilled holes 128*a* and 128*b*. A turn is created by blocking off parts of the drilled holes, such as with epoxy 1902.

Figure 22:
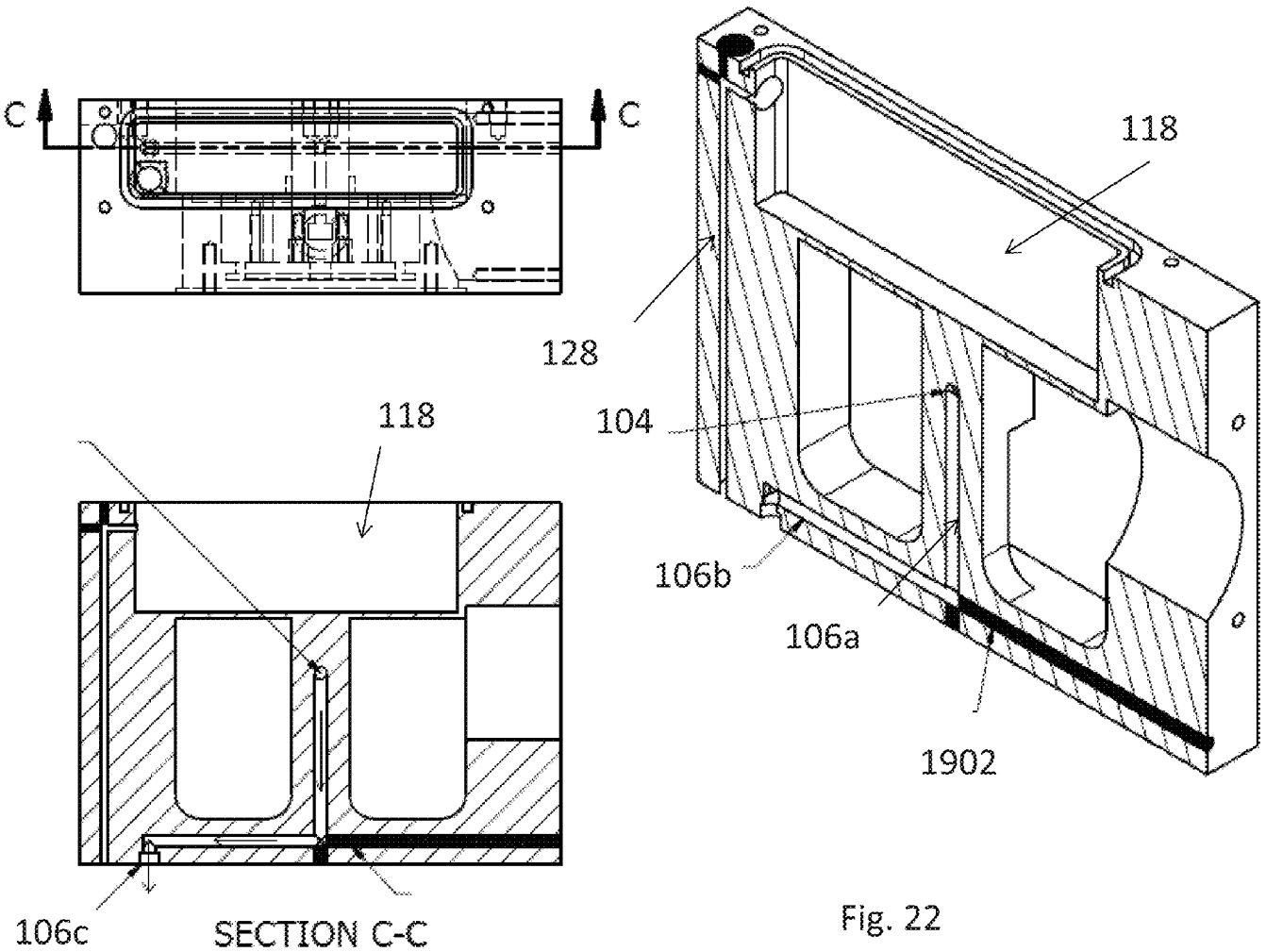
FIG. 22 is an engineering drawing of an embodiment of a burner according to the invention.

FIG. 22 shows a cross section at greater depth than FIG. 21, and is generally aligned with second fluid pathway 106 and partially through fifth pathway 128. Second fluid pathway is defined with three interesting drilled holes 106*a*, 106*b* and 106*c*, capped with epoxy 1902 to form the closed pathway. Hole 106*c* extends through the bottom of the block and will connect to the lower portion 106*d* (FIG. 15); portions 106*a*-*d* collectively form the second pathway 106.

FIG. 23 shows a cross section at greater depth than FIG. 22, and is generally aligned with an upper portion 116*a* of third pathway 116. Upper portion 116*a* of third pathway 116 is defined by a drilled hole that extends from the bottom of the block to the secondary fuel tank 118. The lower portion 116*b* of third pathway 116 (FIG. 15) connects thereto and collectively form the thirds pathway 116. The cavity 2002 through which air enters from fan 208 is also best seen in FIG. 22, although it can be seen throughout FIGS. 19-23.

FIG. 24 shows a cross section at greater depth than FIG. 24, and is generally aligned with sixth pathway 124.

In the above embodiment, a single air compressor 102 provides air to distribute fuel to the atomizing head 160 and air to atomize the fuel. However, the invention is not so limited, and multiple air compressors could be used.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. A burner, comprising:
an air compressor;
an atomizing head having an air orifice;
first and second fuel tanks, the first fuel tank being located at least partially below the atomizing head, and the second fuel tank being located at least partially above the atomizing head;
a first fluid pathway connecting the air compressor to the air orifice of the atomizing head;
a second fluid pathway having a first end configured to receive air from the air compressor, and a second end extending into the first fuel tank;
a third fluid pathway connecting from the first fuel tank to the second fuel tank;
a fourth fluid pathway connecting the secondary fuel tank to a distribution point above the atomizing head;
wherein the second and third fluid pathway define at least a portion of a bubble pump;
wherein the burner is configured to use air from the air compressor to both (a) deliver fuel to the atomizing head, and (b) atomize the delivered fuel at the atomizing head.

2. The burner of claim 1, wherein the second fluid pathway having a first end configured to receive air from the air compressor comprises the first end of the second fluid pathway connecting to the first fluid pathway.

3. The burner of claim 1, further comprising a regulator in the second fluid pathway, wherein the air pressure emerging from the first fluid pathway is higher than that emerging from the second fluid pathway.

4. The burner of claim 1, further comprising:
the second fluid pathway is configured to deliver air from the compressor to the first fuel tank;
the third fluid pathway is configured to deliver to the second fuel tank a mixture of fuel from the first fuel tank and air from the compressor as delivered by the second fluid pathway; and
the fourth fluid pathway is configured to deliver fuel from the second fuel tank to the atomizing head.

5. The burner of claim 1, wherein the burner is configured such that fuel flows from the first fuel tank to the second fuel tank faster than the fuel flows from the second fuel tank to the atomizing head.

6. The burner of claim 1, further comprising a fifth fluid pathway connecting the second fuel tank to the first fuel tank, and is configured to route excess fuel in the second fuel tank back to the first fuel tank.

7. The burner of claim 1, wherein at least portions of the first, second and third pathways are defined by drilled holes in a block of material.

8. The burner of claim 1, wherein the bubble pump is configured to receive air from the air compressor along at least the second pathway, generate bubbles from the received air, and direct the bubbles into at least the third pathway, wherein rising movement of the bubbles carries fuel to the second fuel tank.

9. The burner of claim 1, wherein the second pathway branches off from the first pathway, such that the second pathway receives air from the air compressor along at least a portion of the first pathway.

10. A burner, comprising:

an air compressor;

an atomizing head having an air orifice in fluid connection with the air compressor;

a fuel tank located at least partially below the atomizing head;

a bubble pump located at least partially within the fuel tank, having an inlet in fluid connection with the air compressor, and having an outlet that at least partially defines a fluid path from the fuel tank to the atomizing head;

wherein in operation air from the air compressor both (a) drives the bubble pump to deliver fuel from the fuel tank into the outlet, and (b) atomizes the delivered fuel at the atomizing head.

11. The burner of claim 10, wherein the bubble pump is configured to receive air from the air compressor, generate bubbles from the received air, and direct the bubbles into the outlet, wherein rising movement of the bubbles carries fuel to the outlet.

* * * * *